US005282424A

United States Patent [19]

O'Neill

[11] Patent Number: 5,282,424

[45] Date of Patent: Feb. 1, 1994

[54] HIGH SPEED TRANSPORT SYSTEM

[76] Inventor: Gerard K. O'Neill, 127 McCosh Cir., Princeton, N.J. 08540

[21] Appl. No.: 792,268

[22] Filed: Nov. 18, 1991

[51] Int. Cl.[5] ..... B61B 13/08

[52] U.S. Cl. ..... 104/282; 104/284; 104/138.1; 105/365

[58] Field of Search ..... 104/281, 282, 283, 138.1, 104/130.1, 290, 284; 105/365

[56] References Cited

U.S. PATENT DOCUMENTS

| | | | |
|---|---|---|---|
| 1,020,942 | 3/1912 | Bachalet . | |
| 1,020,943 | 3/1912 | Bachelet . | |
| 3,664,268 | 5/1972 | Lucas et al. . | |
| 3,717,103 | 2/1973 | Guderjahn . | |
| 3,738,281 | 6/1973 | Waidelich . | |
| 3,763,788 | 10/1973 | Pougue | 104/130.1 |
| 3,783,794 | 1/1974 | Gopfert et al. . | |
| 3,806,782 | 4/1974 | Matsui et al. | 104/282 |
| 3,849,724 | 11/1974 | Ghibu et al. . | |
| 3,861,321 | 1/1975 | Goodnight et al. . | |
| 3,865,043 | 2/1975 | Schwarzler . | |
| 3,871,301 | 3/1975 | Kolm et al. | 104/282 |
| 3,913,493 | 10/1975 | Maki et al. . | |
| 3,924,537 | 12/1975 | Matsui et al. | 104/282 |
| 3,954,064 | 5/1976 | Minovitch | 104/138.1 |
| 4,023,500 | 5/1977 | Diggs | 104/138.1 |
| 4,055,123 | 10/1977 | Heidelberg . | |
| 4,075,948 | 2/1978 | Minovitch | 104/138.1 |
| 4,148,260 | 4/1979 | Minovitch | 104/138.1 |
| 4,299,173 | 11/1981 | Arima et al. | 104/284 |
| 4,603,640 | 8/1986 | Miller et al. | 104/282 |
| 4,646,651 | 3/1987 | Yamamura et al. | 104/290 |
| 4,866,380 | 9/1989 | Meins et al. | 104/284 |
| 4,960,760 | 10/1990 | Wang et al. | 104/138.1 |

FOREIGN PATENT DOCUMENTS 3612847 10/1987 Fed. Rep. of Germany ..... 104/281

OTHER PUBLICATIONS

O'Neill, G. K., "Magnetic Flight", Fundamentals of Physics, Holiday and Resnick, 3rd Ed. E13-1 E13-6 (1988).

*Primary Examiner*—Robert J. Oberleitner
*Assistant Examiner*—Kevin D. Rutherford
*Attorney, Agent, or Firm*—Mathews, Woodbridge & Collins

[57] ABSTRACT

A method and apparatus is capable of high-speed transportation of passengers and/or freight. Vehicles (22) are operated along a guideway (14) as a result of the interaction between vehicle lift, steering and propulsion apparatus, each of which includes coil assemblies that are mounted on the vehicle (22), and magnet assemblies mounted on the guideway (14). Vehicle propulsion is provided by the interaction of currents on the vehicle (22) with time-varying magnetic fields that are generated along the guideway (14). The coils and magnets interact in accordance with the magnitude of electric current passing through the coils and the strength of the magnets' fields, to give lift and directional control to the vehicle. The lift and steering magnets (92, 94, 120, 122) provide substantially uniform magnetic fields so that the interaction between the lift coils and lift magnets, and respectively between the steering coils and steering magnets is substantially independent of positioning of the corresponding coils (104, 106, 108, 124, 126, 128 and 103).

7 Claims, 13 Drawing Sheets

FIG. 3
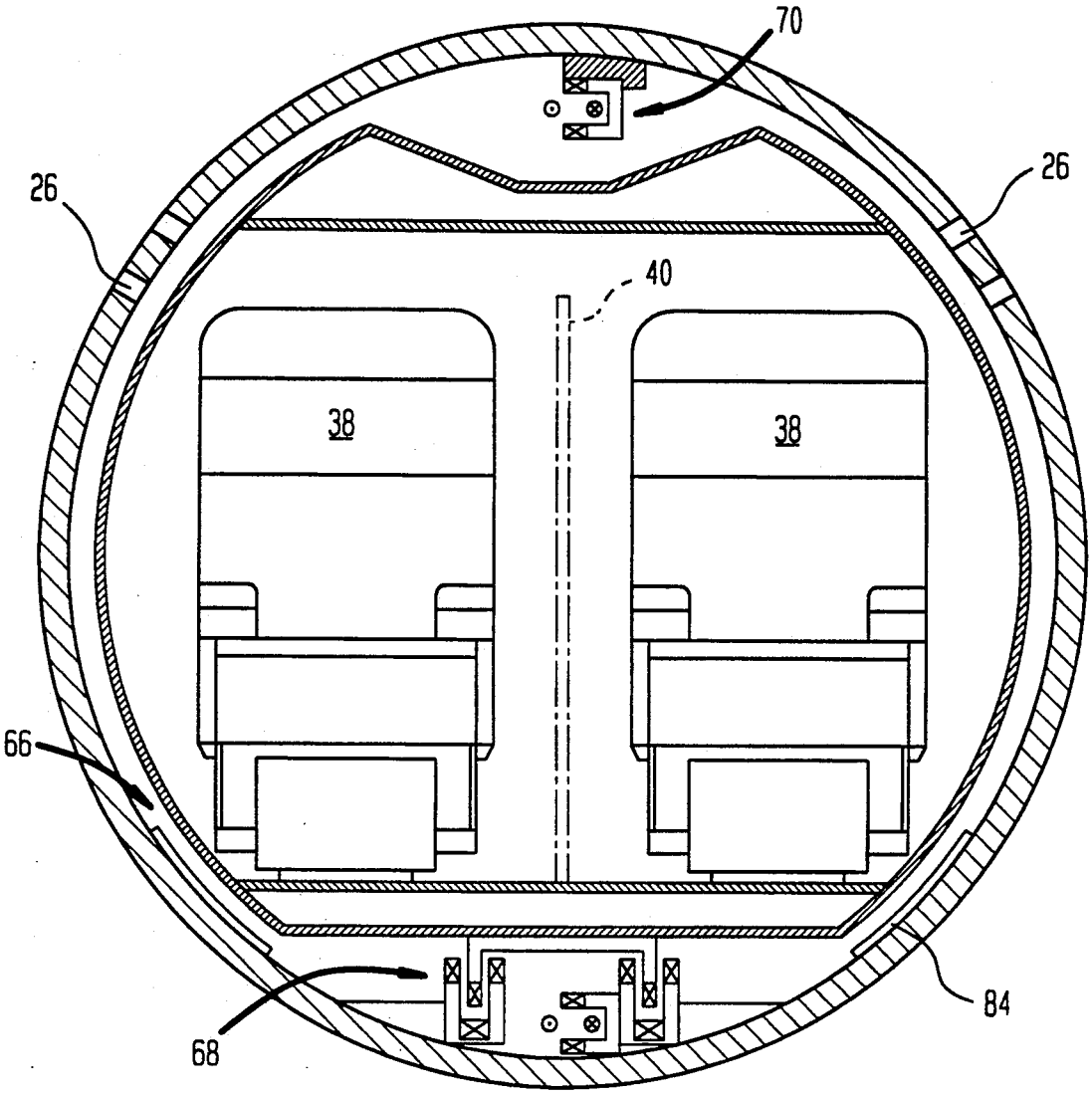
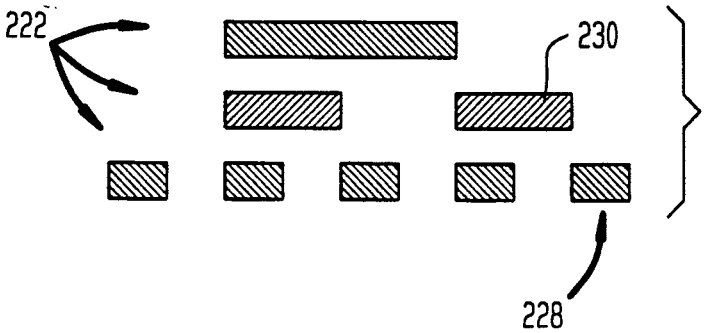
FIG. 13

HIGH SPEED TRANSPORT SYSTEM

BACKGROUND OF THE INVENTION

1. Field of the Invention

The invention relates generally to ground-based transport systems, and particularly to transport systems comprising vehicles which are magnetically lifted rather than mechanically lifted, and which are propelled magnetically while so lifted.

2. Description of the Related Art

The dramatic rise in urban and suburban populations, and the environmental and economic impacts that have accompanied such increases, have given new urgency to the development of a transportation technology that can transport large numbers of passengers rapidly, conveniently, economically, safely and reliably across distances as short as those of urban commuter lines or as long as transcontinental trips. A focus by transportation researchers in recent years has been the development of railway or guideway transportation systems as opposed to road or airborne systems. In particular, large efforts have been expended in recent years on the development of superconducting and non-superconducting magnetically levitated (lifted) train-like transport systems.

Most effort to date has focused on the concept of supporting a relatively conventional railway train by magnetic fields rather than by conventional steel wheels riding on steel rails. With large financial and technical support from their respective governments, Japanese and German research teams have expanded upon and developed experimental magnetic levitation (maglev) transportation research, some of which was pioneered in the United States. The research teams' respective implementations of magnetic levitation, however, differ greatly. For example, the Japanese system relies for lift upon the force which arises when strong electric currents, which are maintained in superconducting coils mounted within the cars, generate induced currents in a conducting guideway as the cars and coils associated therewith move along the guideway. The magnitude of this generated force is (roughly) inversely proportional to the separation distance between the coils and the guideway. Because the system is planned so far to operate in air like conventional railways, it is subject to aerodynamic drag, which increases power requirements and creates noise.

In the Japanese system, separation distances between the superconducting coils and the guide rails of the order of about 10 cm can be attained. Separation distances of this magnitude allow misalignments of the guide structure to be tolerated, because with large separation distances catastrophic contact between the cars and the guide structure are (other things being equal) less likely to occur than with closely-spaced systems.

A major difficulty with the Japanese system is that, as the superconductor currents once set cannot be changed moment to moment, the cars travel as though "floating" on soft springs whose spring constants and damping cannot be electronically controlled, rather than their oscillations being controlled and dampened by electronic feedback. An additional problem is that when transit speed drops below about 50 kph (the speed below which motion-induced lift generally ceases to be effective), auxiliary support apparatus such as landing wheels must be deployed in order to support the train.

In contrast to the Japanese transport system described above, the transport system which has been developed in Germany makes use of forces of magnetic attraction rather than repulsion. In the German system, conventional (i.e. non-superconducting) electromagnetic coils are positioned along lateral skirts of the rail cars and work to lift the rail cars toward a steel guideway positioned above the skirts of the rail cars. An advantage of this system is that it avoids the relatively advanced technology and the consequent capital and operating expenditures typically associated with superconductivity. However, the force of electromagnetic attraction is inherently unstable and requires sophisticated feedback control to ensure that the magnetic forces do not cause a car to come into contact with the overlying guideway. Because the linear density (kg/meter) of the German train is, like the Japanese train, relatively high, and magnets of conventional design can only provide the necessary strong forces without excessive power loss by using small rather than large air gaps, the clearance can only be of the order of about 1 cm. To ensure that the separation distance does not change above or below that optimal operating distance of about 1 cm during the course of vehicle operation, a highly nonlinear feedback system is required. The small separation and consequent tight tolerances in the guideway inherent in this system are reasons for concern as to its further development and its practical operating speed, as maintaining tight tolerances in the guideway is difficult. System operation is further complicated by environmental factors such as wind shifts, rainfall and debris, any or all of which are likely to be present occasionally and which can act to induce sudden, undesirable changes in vehicle position with respect to the guideway, in the worst case leading to physical contact.

Despite the foregoing system limitations, interest in magnetic levitation as a means for making better local and long distance terrestrial transport systems has increased over the years, as such transport systems should be capable of higher operating speeds and lower mechanical wear than conventional, wheel-on-rail transport systems. Furthermore, maglev systems even operating in the air are quieter than their conventional wheel-on-rail counterparts, and are therefore not as likely as conventional systems to meet with public opposition if proposed for location in urban areas.

As the current state of the art in magnetic levitation provides for the operation of such transport systems above ground, exposed to the surrounding environment, a principal limitation to the maximum operational speed of these transport systems has been aerodynamic drag and, as a separate point, noise. Such aerodynamic considerations have imposed a practical speed limitation of on the order of 500 kph for such transport systems, a speed which has also been reached, but only under experimental conditions by an unloaded train, in speed tests by a state of the art wheel-on-rail system, namely the French TGV-A system. The next operational TGV-A train is being built in France for an operating speed of about 300 kph. Clearly, wheel-on-rail technology is reaching its limits, because ⅔ of that speed was available for normally scheduled trains in the United States in the 1930's. Maglev systems depending on attraction, and therefore using small clearances, also would raise safety concerns if operating speeds were to be high.

In view of the foregoing limitations, an object and advantage of the present invention is to provide a high speed transport system that is safe, economical to build and operate, uses very little energy, provides for the transportation of large numbers of people and/or freight at higher speeds than are possible with conventional ground-based transportation systems, and is as far as possible environmentally benign. The present invention is also designed to occupy minimum width and to conform to existing rights of way, for example median strips on highways.

A further object and advantage of the subject invention is to provide a magnetically levitated transportation system which minimizes the exposure of the passengers transported thereby to magnetic fields used by the transport system in the course of its operation.

A further object and advantage of the invention is to provide a transport system that is closely and tightly controlled, yet provides a smooth ride, i.e., does not generate or transmit to passengers jarring forces.

Yet a further object and advantage of the invention is to provide a high speed transport system that is substantially isolated from aerodynamic and climatological influences and from acts of vandalism.

These and other objects and advantages of the subject invention will become apparent from a reading of the following detailed description and the accompanying drawing figures.

SUMMARY OF THE INVENTION

Briefly described, the invention comprises a method and apparatus for high speed ground-based transportation of passengers and/or freight. The transportation routes can be optimized for urban commutes or the inter-city up to transcontinental distances. The transportation system is operable above, below and at ground level along evacuated and non-evacuated guideways. The system provides considerably greater levels of passenger throughput than has been possible prior to the development of the present invention.

In the transport system of the present invention, passengers and/or freight are transported with independently operable and controllable vehicles along a vehicle guideway. In a preferred aspect of the invention, the guideways are enclosed in partially evacuated tunnels referred to as "pipelines". Vehicle operation along evacuated guideways is advantageous, for it permits the vehicle to be designed and controlled independently of aerodynamic considerations and to reach high speeds at low energy cost.

Each vehicle is comprised of a pressurizable cabin from which extend from the forward and back ends thereof auxiliary support structures or wings. As the wings extend vehicle length while contributing minimally to the total vehicle weight, force per unit length exerted by the vehicle on the guideway and any related guideway support structures such as bridges can be reduced. Consequently, guideway components such as magnets can be smaller, lighter and less expensive.

Vehicles are operated along the guideways through the interaction between vehicle lift, steering and propulsion apparatus, each of which includes coil and magnet assemblies that are mounted to the vehicle and guideway. In a preferred aspect of the invention, the vehicle lift and steering magnets are configured as a continuous guideway having flat parallel pole faces, which provide substantially uniform fields along their lengths and most of their pole widths. The guideway magnets can be permanent or electrically energized magnets. Current carrying coils extend from the vehicle. The coils are attached to a wing structure located forward and aft of a vehicle cabin, and lift coils may also be mounted under the cabin. The vehicle coils are received within the open space defined by the guideway magnets. For fixed total coil weight and power, wings allow the coils to be of smaller cross-section, which in turn allows the guideway magnets to be smaller and less expensive. The coils and magnets interact in accordance with the magnitude of electric current passing through the coils to give lift and directional control to the vehicle. This arrangement of lift and steering coils extending through the wings also maximizes the steering torques which can be generated to provide vehicle yaw and pitch control. Vehicle propulsion along the guideway is provided by the interaction of current produced on the vehicle with magnetic fields that are propagated along the guideway. In the preferred embodiment, the speed of propagation of the moving magnetic wave corresponds to the desired rate of vehicle travel (i.e. a linear synchronous speed) and is provided in the preferred embodiment only along that portion and the adjacent portions of the guideway in which the vehicle or group of vehicles is travelling.

The magnetic fields developed by the guideway are also operable to provide power to systems such as climate control and vehicle communications and control systems on board the vehicle. Because the driven coils of the vehicle propulsion system are provided only along the vehicle wings, passengers and freight are not exposed to the magnetic fields that are generated by those coils. The same is true of the vehicle steering coils, which are also mounted on the wings.

BRIEF DESCRIPTION OF THE DRAWINGS

Further objects and advantages of the present invention will become apparent from the following description of the preferred embodiments taken in conjunction with the accompanying drawings, in which:

FIG. 3 is a view along the line 3—3 of FIG. 2;

FIG. 13 is a view of a portion of a barcode segment used along the tunnel inner surface.

DETAILED DESCRIPTION OF THE PREFERRED EMBODIMENTS

Figure 1:
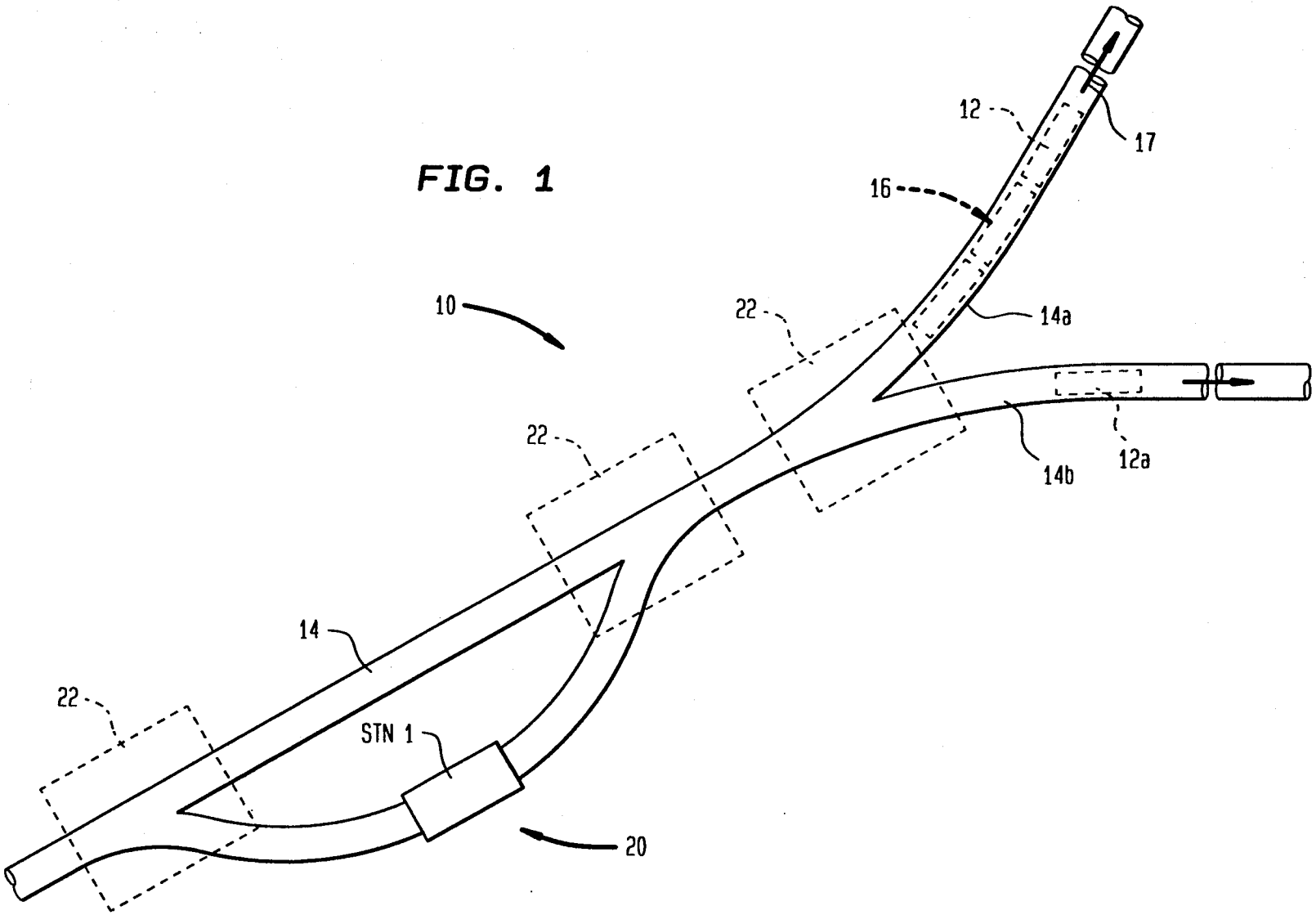
FIG. 1 is an overhead view of a transportation system in accordance with the present invention.

With reference to the drawings, wherein like reference characters represent corresponding parts throughout the various views, and with particular reference to FIG. 1, there is depicted a high speed transport system in accordance with the design of the present invention, indicated generally by reference character 10. The transport system 10 comprises one or more vehicles 12 that are transportable along a guideway 14. In high speed applications, it is preferably enclosed in a pipeline or tunnel 15 through which the vehicle 12 is adapted to pass.

The term guideway includes generally passive (constant-field) magnets which interact with active lift and steering magnets on the vehicle, and active (linear motor) magnets or coils, which provide normal acceleration and deceleration forces, and which can also be used to provide higher decelerations for emergency stops. In addition, in cases where the guideway is within a partially evacuated pipeline, that pipeline includes tunnel accessory apparatus such as safety valves capable of isolating sections of pipeline, and vacuum control, provided to ensure optimal operation of the transport system. The vehicles 12 are configured so as to be transportable along the guideway 14 as self-contained units in the manner described below and are preferably assembled into closely spaced linear arrays or trains 16 whereby two or more vehicles maintain a close spacing of on the order of from about 2 cm to about 10 cm, as can be accomplished by computer-managed electrical position control. As is shown in the drawing, the transport system 10 is comprised of a guideway or guideways connecting a plurality of stations 20, one of which is designated in the drawing by reference character STN 1 to facilitate its differentiation in the discussion provided below.

The direction of train travel in the drawing can be either to left or right, but for a discussion example is indicated by the arrow 17, in which the train 16 is shown in transit, having originated at station STN 1 or having come from a longer distance. In order to maximize speed and passenger throughput, the guideways are configured as tubes of minimum turn curvature, which are provided with switches 22 which permit vehicle travel along one of two or more available courses toward different intended destinations. The switches 22 are driven by mechanical apparatus described in detail below which can be configured so as to be controlled by a guideway computer system, or upon receipt of commands from an onboard computer provided with each train 16 well ahead of the time when the train approaches the switch. As is shown in the drawing, the train 16 has been diverted by the guideway switching apparatus 22 toward the left alternative route along guideway section 14*a*. In accordance with a further aspect of the invention, the details of which are described below, vehicle 12*a* has been separated from the train 16 prior to the switch 22 and is depicted on the right-going alternative route. Vehicle separation from the train can occur, for example, by positioning the one or more vehicles 12*a* to be separated from the train at the back end of the train and diminishing their rate of transit relative to that of the remainder of the vehicles, thereby allowing the remainder of the vehicles constituting the train 16 to advance along the guideway 14 away from the separated vehicle 12*a*. Once the train 16 has passed through the switch 22 en route to its destination, the switch 22 is operated in the manner described below to provide a path for the separated vehicle 12*a* that provides for vehicle transit from guideway section 14 to guideway section 14*b*, thereby providing for vehicle transit on the right-going alternative route. The foregoing method avoids the inconvenience, inefficiency and time delay that is associated with diverting the entirety of the train 16 and the passengers transported thereby to a station which only a relatively small fraction of the train passengers have as their intended destination. The method is therefore capable of providing nonstop express service to all passengers for all destinations.

It is to be appreciated from the foregoing general description that train length can vary in accordance with the number of vehicles, baggage and/or freight to be transported. Furthermore, just as trains can be partially disassembled prior to their arrival at guideway switches 22 in the manner described above, trains of vehicles traveling in relatively close proximity to one another can be assembled from individual vehicles for example originating from different stations while en route to a common destination to the right of the figure, such as station STN 1 in FIG. 1, in which instance the directional arrows for vehicle and train travel depicted in the drawing and the manner of relative vehicle and train rates of operation would be reversed from that shown. As with the aspect of train disassembly described above in connection with the figure, train assembly in the foregoing manner maximizes the efficiency and passenger throughput of the system by providing for the convergence of vehicles 12 originating from, for example, various suburban centers for transport to a common urban center in the manner that would be desirable for operation of the transport system both in long distance installations and in regional or commuter transportation systems. In those two cases the basic technology would remain similar, but such parameters as maximum speed intervals between trains, and even the choice of operation in normal air or in a pipeline could be different.

Figure 2:
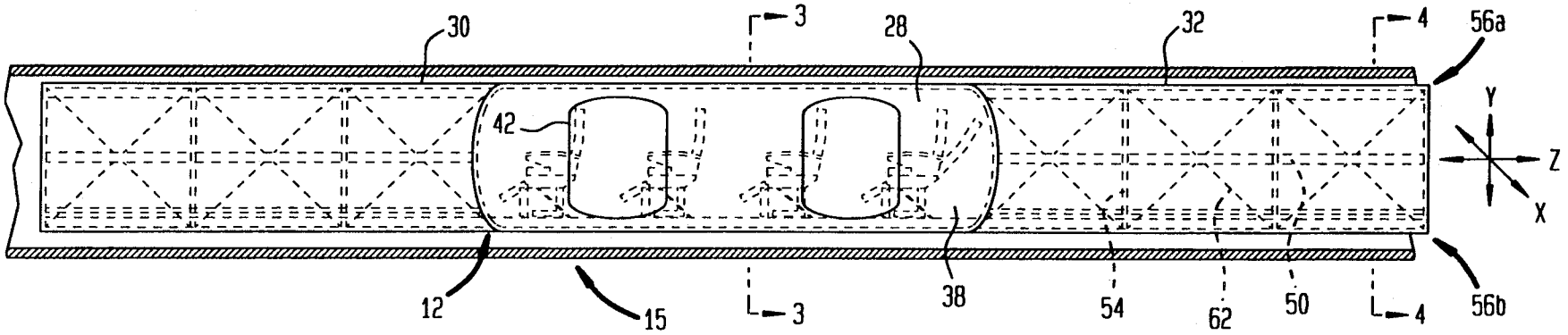
FIG. 2 is a sectional side view of a vehicle within a section of guideway.
Figure 4:
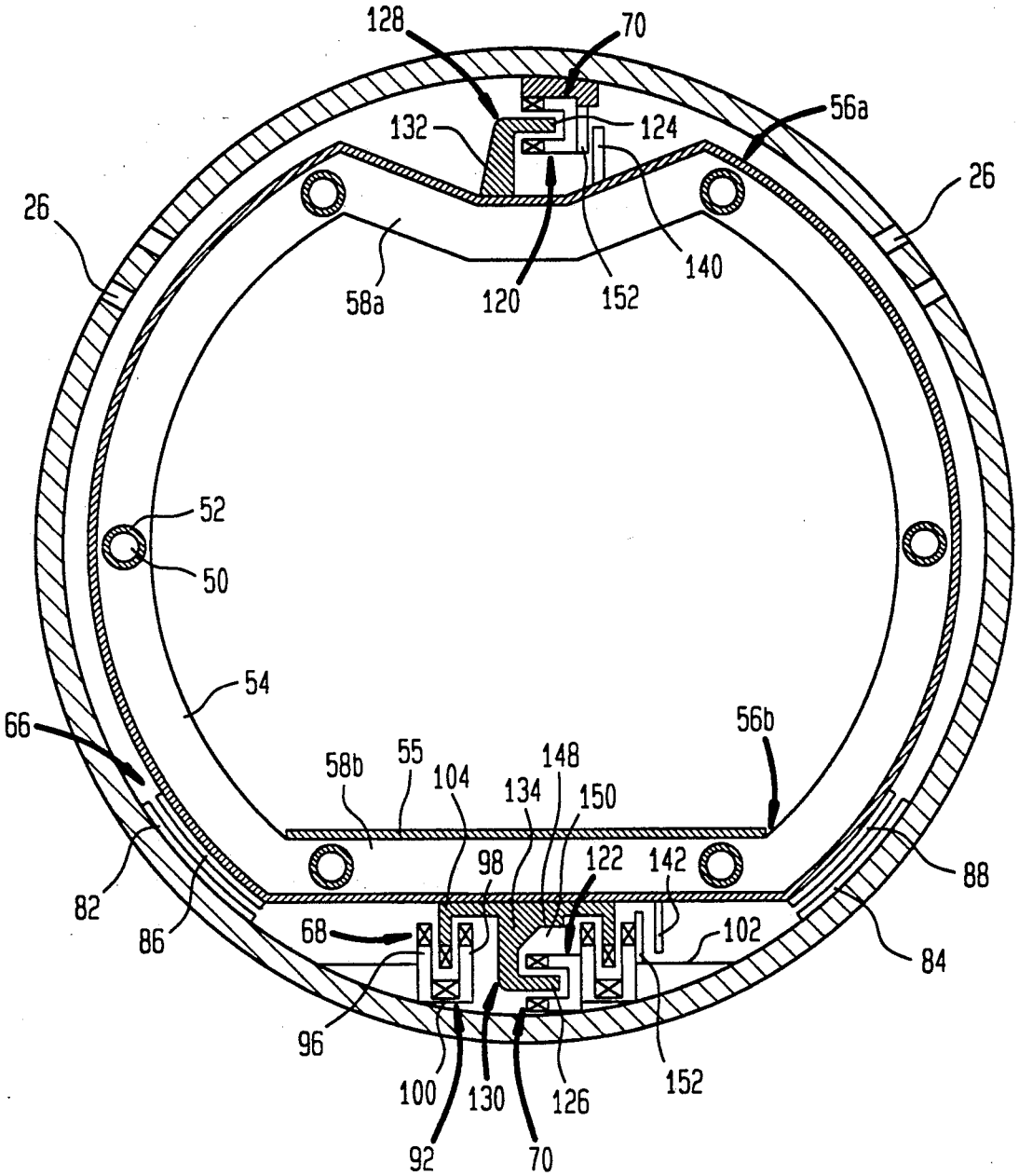
FIG. 4 is a view along the line 4—4 of FIG. 2.

As was noted above in connection with the description of the general transport system 10, the guideways 14 are preferably received within closed cylindrical tubes 15 of relatively small diameter in comparison with existing passenger/freight transportation systems. One such tube 15 is shown in FIGS. 2–4. While the depicted tunnel configuration is of a circular cylindrical cross-sectional configuration, it is to be appreciated and understood that variations therefrom are encompassed by the present invention. The tubes 15 can be positioned above ground, below ground, partially submerged, or any combination of the foregoing in accordance with such factors as cost, the availability of rights of way, environmental sensitivities system operator preference, and geographical and seismic characteristics of the region. The tubes are preferably evacuated to an atmospheric pressure of the order of about $10^{-3}$ to about $10^{-5}$ atmosphere, a pressure which is comparable to that which can be found at high altitudes above the earth's surface where drag is small. The tunnels are evacuated to this low pressure in order to minimize vehicle aerodynamic drag, achieve correspondingly high energy efficiency, virtually eliminate noise, and allow simple computer analysis of the motion of each vehicle as a nearly rigid body in vacuum. The last point allows the use of relatively simple guidance systems. This range of pressures can be obtained economically without complex pumps. Evacuation is accomplished by drawing via associated pumping apparatus (not shown) air through apertures 26 formed at intervals in the tunnel wall. The effect is to remove air, airborne contaminants and moisture from the tunnel, thereby reducing the presence of impediments to high speed vehicle transit along the guideway within the tunnel.

With further reference to FIGS. 2–4, construction details of the vehicles 12 and the interaction between components mounted thereon with complementary components which form the guideway, normally mounted along the interior of the tunnel 15, will now be described.

With particular reference to FIG. 2, the vehicle 12 comprises a passenger or freight cabin 28 to which are mechanically attached fore and aft wing assemblies 30 and 32, respectively. The load associated with the cabin and its passengers and/or freight is preferably distributed along the length of the vehicle and the respective lifting apparatus described below that is associated with the vehicle cabin and the fore and aft wings. In a preferred aspect of the invention, the vehicle 12 has a length of about 14 meters, one-third of which is associated with each of the cabin and wing components. That ratio can, however, be different in various systems. The vehicle can also be upwardly or downwardly scaled in accordance with a variety of transport system objectives and can be configured to accommodate different numbers of passengers.

The extended wings are important to the goal of reducing the cost of the guideway by allowing the guideway to provide full support to the vehicle with magnets which are of small cross-section and modest field. Achieving the goal of minimum guideway cost can be viewed, alternatively but with the same mechanism, as carried out by increasing to a practical maximum the fraction of guideway length which is occupied by vehicles. That saves cost because by reducing the number of unoccupied sections and costs for the guideway are reduced without reducing the system's functioning.

In the design of extended wings, for the same vehicle coil volume and power, and the same guideway field, there is no dependence on the ratio of wing to cabin length or on total length. But using a high ratio allows coils to be much slimmer, which allows guideway magnets to be thinner also. That choice also makes it much easier to get rid of coil heat which opens the option of reducing guideway field at the tradeoff of higher vehicle power.

The cabin can be maintained at approximately normal atmospheric pressure in the same manner as, for example, pressurized aircraft, by pumping air into the cabin continuously with variable aperture output to control pressure. A backup, similar to that of pressurized aircraft is to carry oxygen in pressure tanks. Because the vehicle is preferably operated in a pressure environment lower than that which normal aircraft can fly at, a pressure where aerodynamic forces are near zero, the wings 30 and 32 are configured substantially as structural rather than aerodynamic members (i.e., in the same way that spacecraft are designed). In a typical seating arrangement the interior of the cabin 28 is configured to seat eight passengers arranged in two-across side-by-side seats 38 (FIG. 3). The seats 38 are preferably in the form of recliner-type chairs typical of premium class (business or first class) seating on modern airliners. Passengers have control of seatback angles from about 12° after the vertical to a much greater reclining angle. The inclined chair orientation positions the passengers in an angular range which remains comfortable through all normal travel regimes, including normal declaration. A movable partition 40 can optionally be provided between adjacent seats to provide privacy.

One or more doors 42 is provided to permit entry and egress from the cabin interior. The doors 42 are of one of the conventional designs for use in pressurized environments and can be of a type, for example, that are used in some passenger jet aircraft. They are optimally configured so as to be hingedly mounted to the vehicle door frame along an upper edge thereof. This arrangement facilitates cooperation between the vehicle and air locks that are provided at stations 2 (FIG. 1) for establishing normal-pressure access between the station and the interior of the vehicle.

Figure 5:
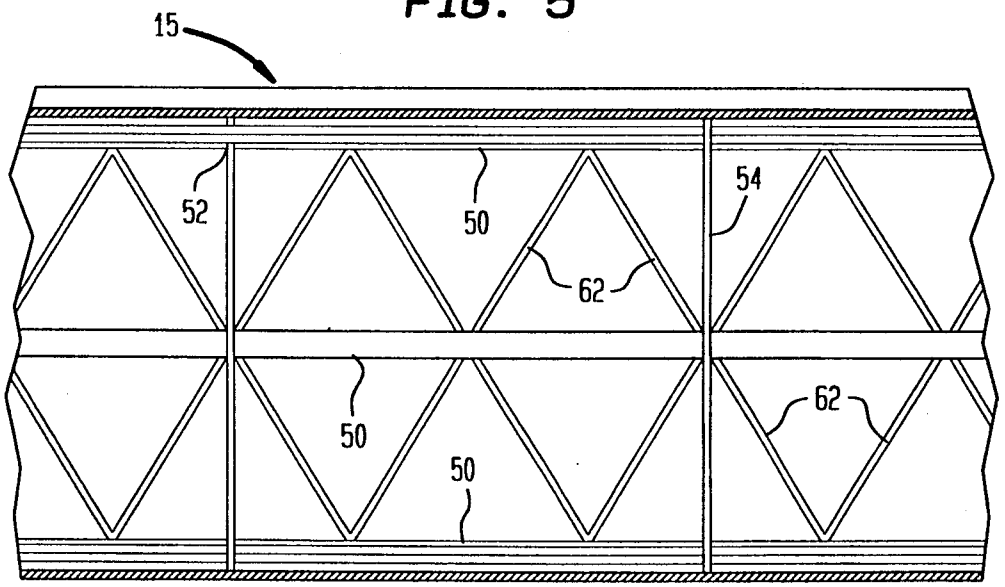
FIG. 5 is a side elevational view of a portion of a vehicle wing.

Details of a wing structural configuration are depicted in FIGS. 2, 4 and 5 and can vary in accordance with the geometrics that are selected for achieving minimum weight, maximum strength and stiffness, and passenger admissibility therethrough in instances of a vehicle or guideway emergency. Each wing is defined by a generally open framework that comprises a plurality of parallel, horizontally-extending longeron tubes 50 which extend through correspondingly dimensioned openings 52 formed in rib frames 54. The frames 54 are positioned generally transverse to the longeron tubes and are longitudinally spaced apart from one another along the wing structure. Each rib frame 54 is preferably provided with a generally curvilinear configuration whose shape generally corresponds closely to that of the tunnel wall (clearing guideway components) 15 in order to maximize the interior open cross-section of the wings. A floor or walkway 55 is provided which extends substantially the length of the wing. As is shown more clearly in FIG. 4, the wing rib frames define at their respective upper and lower ends 56*a*, 56*b* upper and lower horizontal supports 58*a* and 58*b* to which the various vehicle steering and lift apparati described below are connected. A plurality of support trusses 62 (FIG. 2) extend longitudinally and diagonally between adjacent longeron tubes 50 to provide additional support for the structure of the wings 30 and 32. Aerodynamic considerations are generally not of significant import in wing design for operation of the vehicle 12 in a relatively low pressure environment. For systems operating at normal air pressure, a fairing or outer skin (not shown) can optimally be provided along the vehicle wings 30 and 32, and those wings can be built to provide tapering ends so as to minimize aerodynamic forces. The various vehicle operation and climate control systems and related hardware are preferably mounted inside the fairing and along the wings in order to maximize passenger space within the cabin 28. Equipment cooling apparatus is provided along the wings to facilitate heat transfer from the equipment away from the vehicle. The wings can further be provided with radiator areas for transferring heat from the vehicle's current carrying coils to the tunnel walls by conduction, convection and radiation. At the pressures normal for the system both heat radiation and conduction are effective for heat removal.

In order to make the system both safe and practical, it is an important design principle of the subject invention that the motion of each vehicle be precisely measurable and controllable. To that end, in the preferred embodiment the vehicles forming a train are not in direct physical contact, and each vehicle of the transport system is analyzable as an independent, quasi-rigid body in the sense of classical mechanics. A consequence of achieving that simplicity is that the vehicle can be considered to have three mutually perpendicular axes of translational movement, three mutually perpendicular axes of rotational movement, and no other significant degrees of freedom. For illustrative purposes, the three mutually perpendicular axes for translational movement shall be denoted as the x, y and z axes. As shown in FIG. 2, the z axis denotes the direction of vehicle travel along the guideway, the y axis denotes vertical vehicle motion, and the x axis denotes horizontal or side-to-side vehicle motion. Rotational movement about the x, y and z axes shall be referred to as pitch, yaw and roll, respectively. Displacement of the vehicle 12 relative to these respective axes is controllable by various items of magnetic field responsive apparatus in the form of vehicle propulsion apparatus 66, lift apparatus 68, and steering apparatus 70, the details of which are described below.

VEHICLE PROPULSION

Figure 7:
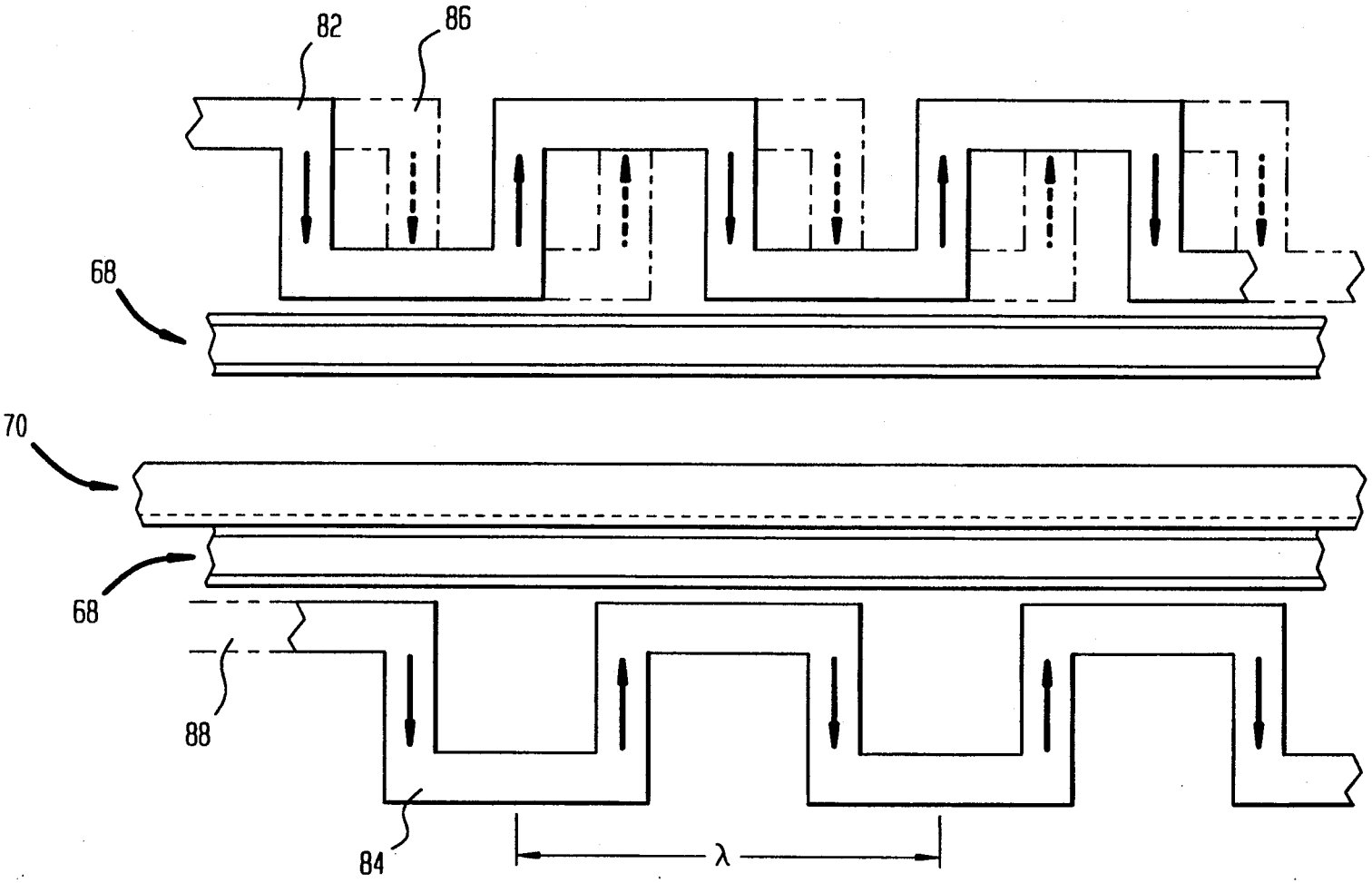
FIG. 7 is an overhead view of Z-axis drive hardware for the vehicle guideway depicted in FIG. 1.

Vehicle propulsion along the longitudinal (z) axis is accomplished in the preferred embodiment by a linear synchronous motor, wherein electric currents generated on the vehicle interact with magnetic fields propagated in the form of waves along the driving elements of the guideway. An alternative propulsion method is the linear induction motor. Both are usable, but we concentrate here on the linear synchronous method, as it is more conveniently capable of precise control. The magnetic field waves are typically propagated along the guideway at a rate that is correct for the vehicular location in the $+z$ or $-z$ directions and the computer program for its speed schedule. Details of the structural configuration for the vehicle propulsion apparatus 66 are depicted in FIGS. 4 and 7. With reference to the drawings, the propulsion apparatus 66 comprises left and right drive stators 82 and 84 positioned along the lower, inner surface of the guideway so as to underlie the left and right sides of the vehicle 12. An alternative placement along the guideway is to the immediate left and right of the vehicle, near the mid-line through the vehicle's center of gravity. As is shown more clearly in FIG. 7, each of the drive stators 82 and 84 is provided with a generally continuous configuration which extends the length of the guideway. As such, each drive stator is characterized by a wavelength $\lambda$ which, in the preferred embodiment, is on the order of about 20 cm.

Sections of each drive stator 82 and 84 are energizable in accordance with control inputs from a guideway control computer described in detail below that is associated with the region of the guideway in the vicinity of the vehicle. The guideway control computer controls, among other things, the frequency of the drive current, and therefore the rate of wave propagation, along a predetermined portion of the drive stators 82 and 84. The magnitude of the force that arises from the magnetic field established by the stators and its interaction with current passing through corresponding driven current conductors 86 and 88 carried by the vehicle is a function of both variables. In the preferred embodiment the regional computer communicates to each vehicle in a manner described below the location of nearby vehicles, and commands increases or decreases in vehicle driven coil current to bring the vehicle to its prescribed spacing from others. The conducters 86 and 88 are mounted along the lower lateral portions of the forward and aft wings 30 and 32 or, alternatively, on the left and right sides of the vehicle wings generally near a line passing through the vehicle's center of gravity, in both instances preferably positioning the conductors in opposed, closely spaced relation with their corresponding drive stators. Because the driven current passes through conductors 86 and 88 which are mounted only along the vehicle wings 30 and 32 (and not the passenger cabin 28), passengers transported by the vehicle are not subjected to the potentially adverse physical affects of significant magnetic fields generated by the driven current conductors 86 and 88. The location of the drive coils, the moderate strength of their fields, and if necessary modest amounts of magnetic shielding on the vehicle act to prevent significant magnetic fields from reaching the passengers. As shown in FIG. 7, the left and right driven current conductors 86 and 88 are provided with a generally alternating sinusoidal configuration that corresponds with the configuration of the stators 82 and 84. Once all of the vehicles 12 of a given vehicle train have passed a given section of the guideway, the drive stators for that guideway section thereafter are switched off by the regional control computer 186 to conserve power.

Two alternatives for phasing are of particular interest. In one, the left and right drive stators are driven in-phase and all windings are symmetrical left/right. That accomplishes an approximate cancellation of forces acting along the x-axis.

In the second alternative, the drive stators 82 and 84 are preferably arranged so as to be 90° out of phase with one another in order to provide for generally smooth drive pulse input to the left and right driven current conductors 86 and 88. The 90° offset of the drive stators 82 and 84, or of the corresponding driven current conductors 86 and 88 on the vehicle, functions to substantially double the frequency of z-axis induced magnetic forces acting on the vehicle 12, and reduce the magnitude of the peak variations in acceleration. Further reduction in the variable component of z-axis acceleration can be obtained by using polyphase, for example 3-phase, drive, as is common in large electronic motors. In operation, a driven current receives maximum z-axis force when situated between two adjacent windings of a drive stator, and receives approximately zero z-axis force when aligned directly with a winding of a drive stator. When the vehicle is positioned so that, for example, the driven windings of the left side are midway between the drive windings of that side, the generally sinusoidal drive current of the left side is at a maximum, and the driven windings on the left side of the vehicle are therefore operable to receive maximum magnetic force from the windings of the corresponding drive stator. In that condition the driven windings of the right side are aligned with the right side drive stator, and carry near-zero current, and near-zero magnetic force in the z-direction. The offset configuration of the windings, either of the drive stators 82 and 84 or of the driven windings, therefore doubles the frequency of z-axis oscillatory drive, and also ensures that the vehicle can be accelerated from rest regardless of the vehicle position in the z direction. Further, when the car is at rest, the drive stator that is aligned with vehicle driven conductors can be energized to produce maximum coupling with the driven windings, which then act as a transformer secondary, to supply power to the vehicle for such purposes as lighting and air conditioning without initiating z-axis motion.

VEHICLE LIFT AND STEERING OPERATIONS

The manner in which the vehicles are lifted and guided through the guideway will now be described in connection with FIGS. 3 and 4. The vehicle is magnetically levitated by a system 68 which employs the interaction of its own current-carrying coils with an approximately uniform magnetic field provided by the guideway. The uniform magnetic field is established in the guideway structure, and the current carrying coils are preferably provided on the vehicle; however, the opposite design alternative is also possible.

In accordance with the present invention, uniform magnetic fields are provided by lift magnets 92 and 94 which are disposed generally parallel to one another along the longitudinal axis of the guideway 14 along its lower end. The lift magnets 92 and 94 can be formed from electromagnets which receive power from a corresponding guideway power supply or from permanent magnets which require no electric power. Individual lift magnets are preferably formed as continuous members having a generally U-shaped cross-sectional configuration, whereby each lift magnet is comprised of two generally parallel legs 96 and 98 which depend from a central portion 100 of the magnet. The individual lift magnets 92 and 94 are positioned in line so as to form one substantially continuous lift magnet assembly along the left and right sides of the lower guideway structure. In a preferred aspect of the invention, the lift magnets are mounted on a supporting assembly 102 that is positioned along an inner surface of the pipeline. The supporting assembly 102 facilitates alignment and installation of adjacent sections of the respective lift magnets and positions the lift magnets such that each magnet central portion 100 is secured to the supporting surface with the magnet legs 96 and 98 extending upward therefrom. Alternatively, the lift magnet sections can be mounted directly to the pipeline, with geometrically adjustable mountings.

Figure 8:
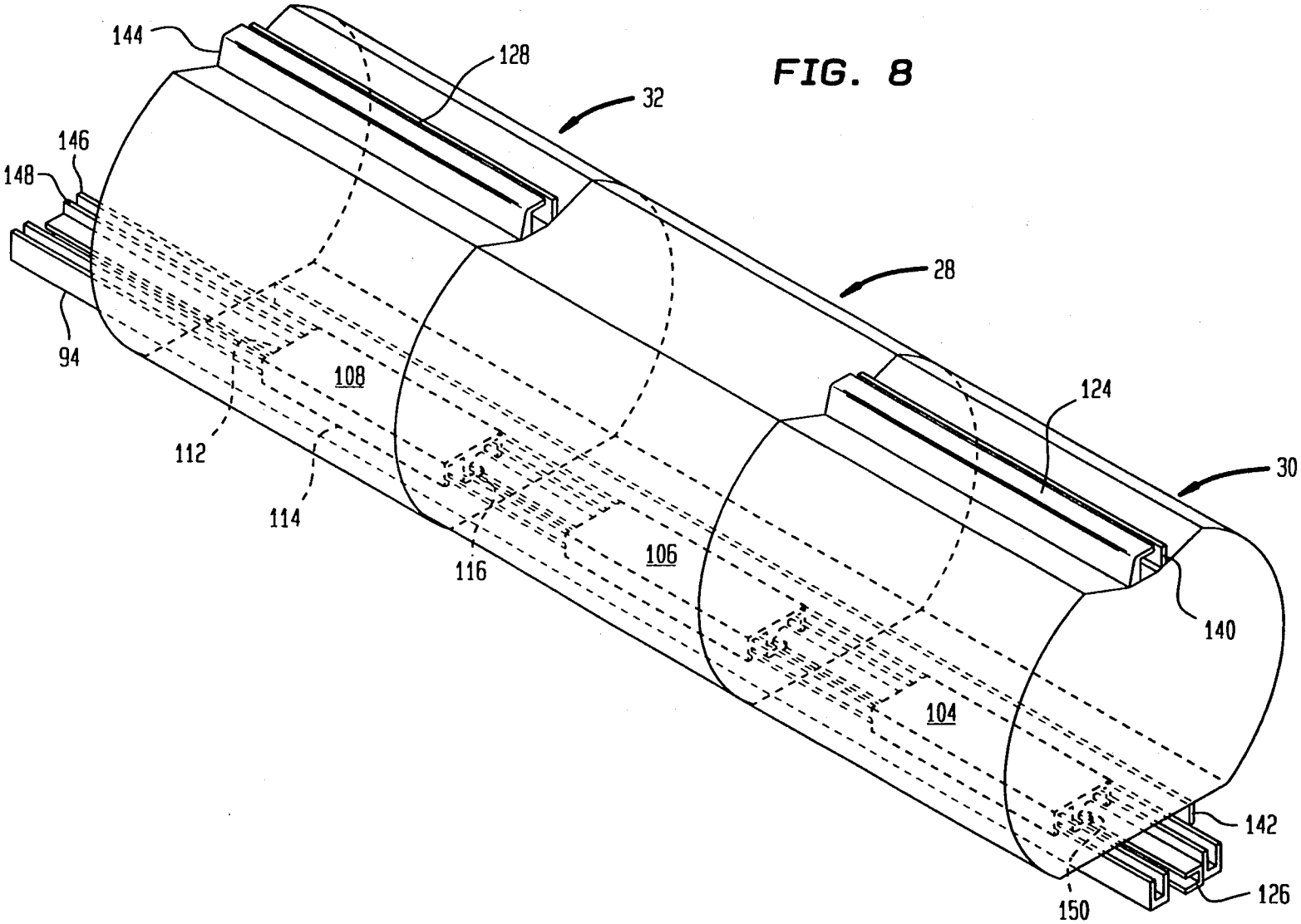
FIG. 8 is a schematic perspective view of a vehicle and its associated drive, lifting and steering apparatus.

Vehicle lift is provided by the interaction with the lift magnets 92 and 94 of current-carrying lift coils 104 (L1), 106 (L2) and 108 (L3) that are positioned along the bottom of the forward wing 30, passenger cabin 28, and aft wing 32, respectively. As shown in FIG. 8, the lift coils 104, 106 and 108 are generally configured as nearly rectangular, continuous loops with upwardly curved ends so as to provide clearance between their cross members 112 and the lift magnets 92 and 94. As the vehicle traverses the guideway, the left and right longitudinal lengths 114, 16 of each current-carrying lift coil ride in the generally uniform field region of the corresponding U-shaped lift magnet and experience a magnetic force which is proportional to the magnitude of the current passing through the coil. That force is nearly invariant to the coil position within the lift magnet, because of the approximate uniformity of the magnetic field. The currents are controlled to elevate the coils within the lift magnets so as to maximize the smallest clearance to any stationary structure. A further discussion of vehicle lift control is provided in the discussion of vehicle trajectory control.

Simplicity, precision and effectiveness of control is achieved in the present invention by supporting and guiding the vehicle in a manner which, as far as possible, keeps the six degrees of freedom independent and uncoupled.

To that end, precision control as to the position of the vehicle 12 within the guideway 14 is accomplished by vehicle interaction with a pair of steering magnets 120 and 122 (FIG. 4 and 8) which are disposed opposite to one another along the top and bottom portions, respectively, of the guideway. The steering magnets 120 and 122 are operable to interact with corresponding coils 124, 126, 128 and 130 that are positioned along the upper and lower ends, respectively, of the vehicle forward and aft wings 30 and 32 to provide control forces that are substantially orthogonal to the control forces generated as a result of the foregoing vehicle coil and lift magnet interaction. The coils are arranged into upper and lower pairs 124 and 126, and 128 and 130, at the bow and stern of the vehicle and are respectively positioned along the fore and aft wings 30 and 32.

As with the lift magnets 92 and 94, the steering magnets 120 and 122 are each preferably formed as continuous members having a generally U-shaped cross-section which provides substantially uniform magnetic fields. The respective upper and lower steering coils extend from supports 132 and 134, respectively, and into the corresponding steering magnet's field so as to interact therewith in accordance with the magnitude of current that is directed through a given coil. The vehicle guidance coils, therefore, experience a force which is proportional to the vehicle coil current and dependent in direction on its sign, and is nearly invariant to position within the gap of the generally U-shaped steering magnet due to the near-uniformity of the magnetic field.

Figure 6A:
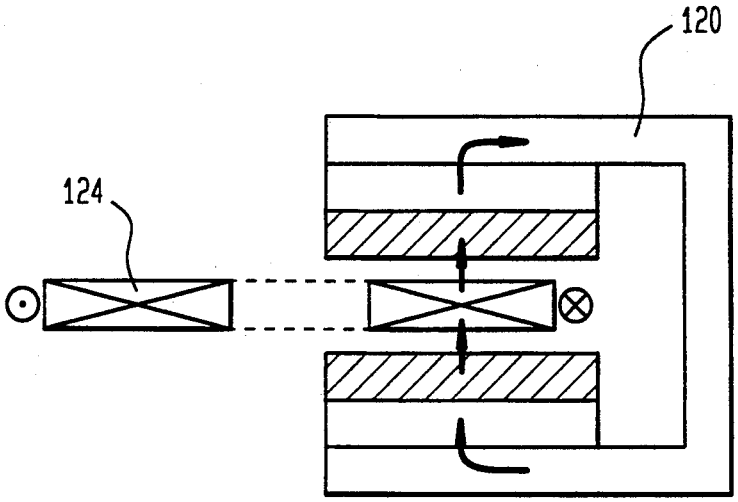
FIGS. 6A and 6B depict alternative magnet geometries from those depicted in FIG. 4.
Figure 6B:
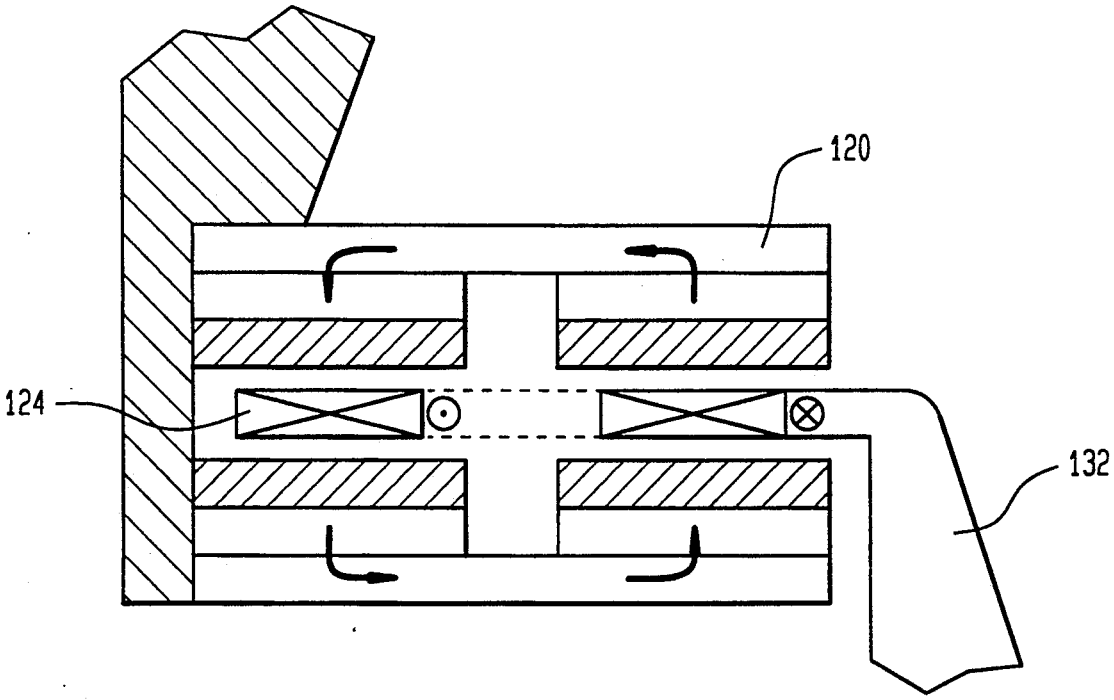

An alternative to the steering magnet design given in FIG. 3 and FIG. 4 is now given, and illustrates also the possibility that lift and steering magnets can be (and by preference will be) driven by permanent magnets rather than by currents. FIG. 6A shows a permanent-magnet version of the upper steering magnet 120 and vehicle steering coil 124. FIG. 6B shows an alternative in which both the $+z$ going and the $-z$ going currents of the upper steering coil are in magnetic fields and receive forces in the same (reinforcive) direction. In FIG. 6B a volume of permanent magnet material equal to that of FIG. 4A is disposed to establish two magnetic field regions, one with the magnetic field up and one with the magnetic field down. The flux of the magnetic field flows upward across one gap, crosses in a return yoke of steel to the other gap, flows downward in that gap and returns in the other return yoke. The fields in the two gaps are each approximately ½ the field of the U-magnet, but the total length of current in the field is doubled, so the force per unit current remains unchanged.

The alternative arrangement depicted in FIG. 6B offers somewhat smaller vertical height, and better shielding of the stray field of the coil 124. With suitable geometric design it can also be employed for the lower steering magnet.

The vehicle cabin is not provided with steering coils, because such coils, being near the center of mass of the vehicle, could not apply large torques in yaw and pitch (rotations about the y and x axes, respectively). In addition, the passengers and/or freight carried are not exposed to the magnetic fields of steering magnets.

Alternatively, the uniform magnetic field and coils can be provided on the vehicle and in the guideways, respectively. In either case, control by the vehicle offers advantages over control by the guideway. For example, each car can be provided with an onboard computer 135 (FIG. 9) for analyzing the vehicle position with respect to the guideway in the manner set forth below and for correcting the position of the vehicle within the guideway independently of other vehicles. Vehicle position correction is accomplished by selectively applying currents to appropriate vehicle steering and/or lift coils to establish desired forces and torques. This independent control by each vehicle can be rapid because the vehicle is relatively light, and has long steering and lift coil lengths. It was noted earlier that the lever arms for yaw and pitch are therefore large. Lever arm is also maximized for roll, because the steering magnets are as far apart as possible, and are located above and below the center of mass.

In addition to the benefits of achieving fast and responsive vehicle forces and torques, the direct controllability of the coils on each vehicle reduces control system response time, allowing for more rapid correction of any position errors and therefore permitting smaller clearances between the vehicle and the guideway. That acts to reduce guideway magnet size and cost for implementing the system, while maintaining a high standard of safety.

POSITION SENSING

With reference to FIGS. 4 and 8, control of the vehicle lifting and steering forces which act on the vehicle as it travels along the guideway is provided by moderating the amount of current flowing through the lift coils 104, 106 and 108 and the steering coils 124, 126, 128 and 130 mounted on the vehicle. A plurality of position sensors 140, 142, 144, 146, 148 and 150 are preferably provided on the wings associated with the vehicle, as shown in FIG. 8, to detect sensor position relative to, for example, the guideway magnets directly or to plates affixed to the guideway magnets and described below. Lateral position sensing for determining vehicle yaw, roll and/or x-axis displacement is accomplished by processing the output of sensors 140 (S1) and 142 (S2) that are positioned at the upper and lower front end of the forward wing 30 and sensors 144 (S3) and 146 (S4) that are positioned at the upper and lower back end of the aft wing 32. Vertical position sensing for determining vehicle lift and pitch is accomplished by analyzing signal output from sensors 150 (S5) and 148 (S6) that are mounted at the front end of the forward wing 30 and the back end of the aft wing 32. Output signals from each sensor are processed by the onboard computer 135 (FIG. 9) to determine, in a manner to be described in further detail below, the amount of current that is to be supplied to one or more vehicle coils to apply forces and/or torques to correct deviations of the vehicle from the intended path along the guideway.

Each sensor is preferably in the form of an electrostatic sensor having a capacitance sensor plate which extends outwardly from the vehicle adjacent to a metallic portion of the guideway and along a vertical or horizontal plane in accordance with the nature of its position sensing function. The guideway metallic portion can be the side of a lift magnet, a metal strip 152 (FIG. 4) which extends the length of the guideway, or other suitable metallic reference members. Lateral position sensing can be accomplished by analyzing the output from sensors S1, S2, S3 and S4 that are positioned generally parallel to a vertical plane extending along a longitudinal axis of the guideway, whereas vertical position sensing can be accomplished by analyzing output from sensors S5 and S6 that are positioned generally parallel to a horizontal plane extending along the longitudinal axis of the guideway. Capacitance readings which correspond to vehicle position data can be obtained in accordance with the spatial separation distance of the capacitor plate and metal strip or the like. Alternatively, sensor readings can be obtained by providing a metallic film layer or a series of laterally spaced plates along the guideway in parallel relation to the respective sensor plates, and sensor readings can be obtained based upon the relative spatial position of a given sensor and the metallic film or plate.

Signal output from each of the sensors 140 (S1), 142 (S2), 144 (S3), 146 (S4), 150 (S5) and 148 (S6) is preferably forwarded to the computer 135 (FIG. 9) onboard the vehicle 12 in a continuous or high-rate digital manner for processing to permit rapid calculation of vehicle orientation along the guideway and the implementation of appropriate corrective signal input in a feedback control manner to the respective lift coils 104, 106 and 108 and/or steering coils 124, 126, 128 and 130. The onboard computer is operable to determine the vehicle's position and orientation with respect to the guideway by combining sensor signal outputs in the following manner:

$$\text{Lateral Position } (\Delta x) = S1 + S2 + S3 + S4$$

$$\text{Roll} = (S1 + S3) - (S2 + S4)$$

$$\text{Yaw} = (S1 + S2) - (S3 + S4)$$

$$\text{Vertical Position } (\Delta y) = S5 + S6$$

$$\text{Pitch} = S5 - S6$$

Multiplying constants to convert analog or digital readings from the sensors into actual physical position and orientation can be absorbed within the constants of the computer control program. The position as determined can be compared with the intended or scheduled vehicle position stored in computer memory to effect the generation of restoring forces in the two translational degrees of freedom and restoring torques in the three rotational degrees of freedom to return the vehicle to the desired trajectory in the guideway upon detection of undesirable deviations in position or angle. Vehicle velocity and acceleration can be obtained from first and second time derivatives of vehicle position and angle in a manner well known in engineering.

Figure 9:
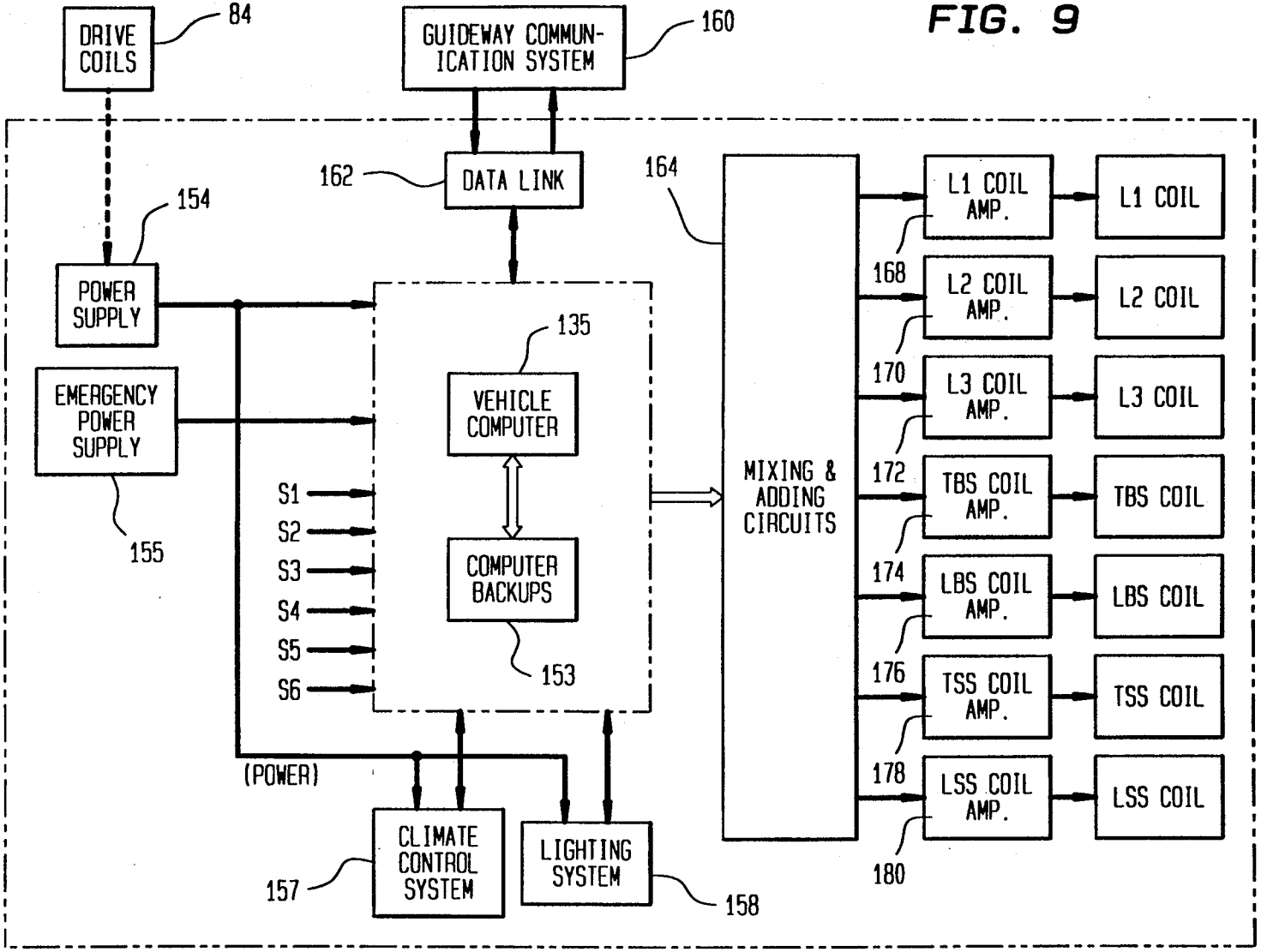
FIG. 9 is a schematic view of the control hierarchy for vehicle lifting and steering.

The manner by which feedback control is provided for implementing changes in vehicle attitude along the guideway is indicated in FIG. 9. As was noted previously, the onboard computer 135 is preferably operative to monitor and analyze sensor data from sensors S1 through S6 continuously or at a high digital rate. It thus determines vehicle position, and controls the generation and application of restoring currents to the appropriate lift and steering coils (generally two or more) to return the vehicle to the desired trajectory when a deviation therefrom is detected. Preferably, redundant processing capability, up to 3-fold or 5-fold, is provided in the form of auxiliary computers 153. The computers 135 and 153 are powered by a power supply 154 on board the vehicle that receives its power (inductively) from the guideway Z-axis drive coils 84 (FIGS. 4 and 7). An auxiliary or emergency power supply 156 is provided on each vehicle in the event of an interruption in power delivery from the coils 84 and related power apparatus. Preferably, the 0 emergency power supply is simple, e.g. storage batteries. Vehicle climate control and illumination is preferably controlled by the computer in accordance with conventional control routine, as denoted by blocks 157 and 158, respectively.

Data concerning various guideway-related parameters such as guideway status is transmitted along an electrical or electro-optical guideway communication system to the onboard computer 135 through an appropriate data link interface, as indicated by blocks 160 and 162. Such communicated data could include, for example, information concerning displacement of guideway lift magnets from the optimal mounting position along the guideway. In accordance with the communicated data and data obtained from sensors S1 through S6, the computer 135 is operable to develop a vehicle travel path that corrects for guideway irregularities such as displaced guideway magnets by controlling to center on an optimum trajectory. It determines vehicle deviations from the optimum travel path and emits signal inputs to the appropriate one or more of the lift coils L1, L2 and L3 and steering coils 124 (top bow steering—TBS), 126 (lower bow steering—LBS), 128 (top stern steering—TSS) and 130 (lower stern steering—LSS). Signal outputs from the computer 135 are processed by appropriate signal mixing and adding circuits (box 164) and are directed to an appropriate one or combination of coils through an appropriate amplifier 168, 170, 172, 174, 176, 178 and 180 that is associated with the respective coil. The provision of data from sensors S1 through S6 to the computer 135 continuously or at a high digital rate allows for feedback control of signal input to the respective vehicle lift and steering coils.

Design of the foregoing feedback system for vehicle control is simplified due to the neutral stability of the vehicle resulting from the provision of lifting and guiding forces that are substantially invariant to vehicle position. The feedback control loop amplifiers for each of the degrees of freedom can be fundamentally similar with the exception of appropriate gain versus frequency and delay versus frequency dependencies, to maximize rapid response, high sensitivity, and overall stability.

Substantial invariance of the magnetic forces on the vehicle to the vehicle's position within the guideway magnets tends to minimize cross-coupling from one degree of freedom to another. This is advantageous in allowing feedback control loops with high loop gain, thereby providing for "stiff" control and rapid response to sensed variables. In contrast, superconducting systems are characterized by comparatively "soft" control, as vehicle position change over relatively large vehicle-guideway separation distances results in generally weak corrective forces, much in the manner of the force produced by a weak spring.

GUIDEWAY CONTROL

Figure 10:
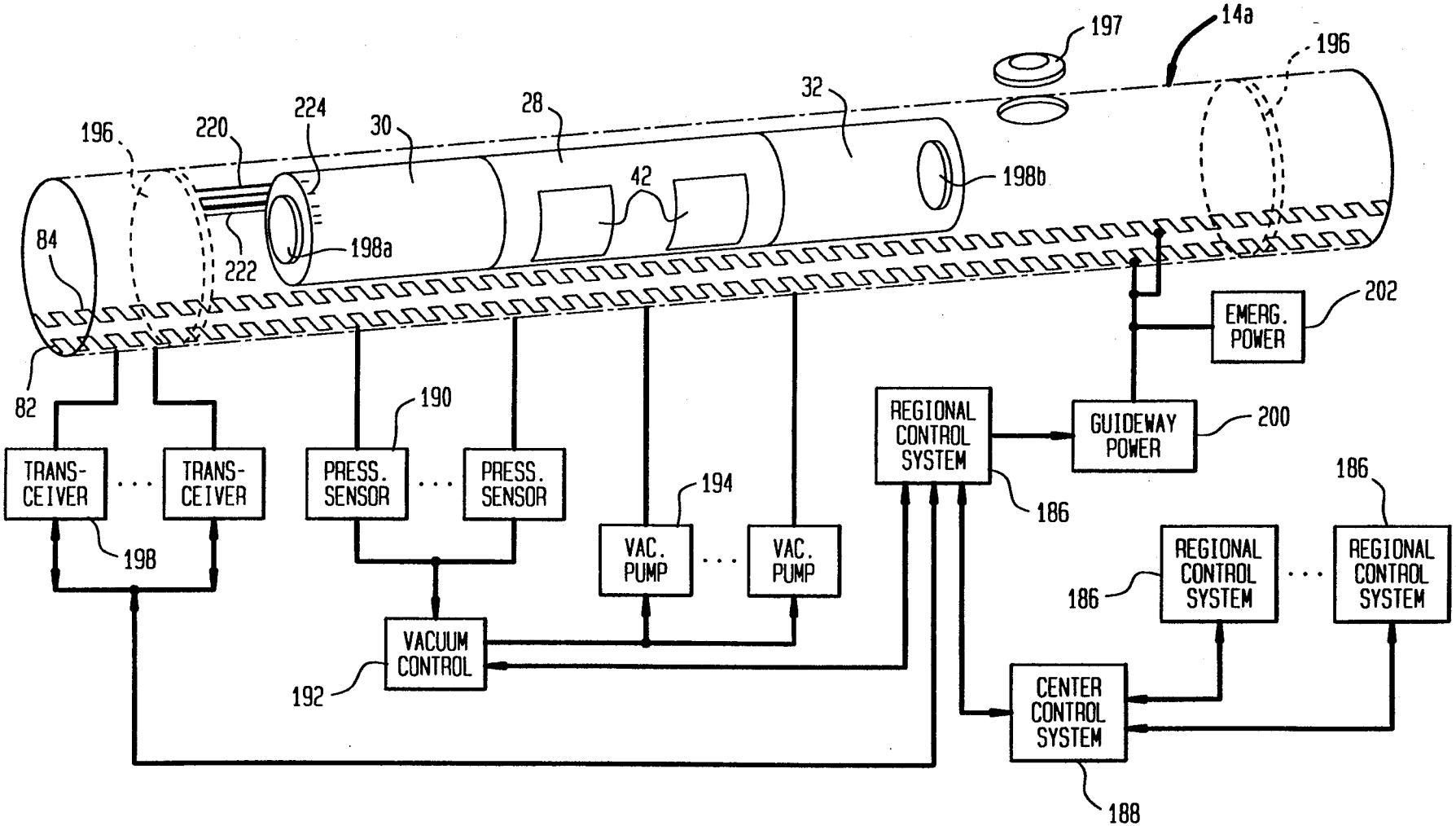
FIG. 10 is a perspective view of a vehicle within the guideway and the guideway control apparatus.

With reference to FIG. 10, there is depicted in schematic form the various items of apparatus associated with operational and environmental control of the guideways 14 of the subject invention. A regional control computer system 186, which is operable to control the various components of one or more guideway sections, is provided at spaced intervals along the guideway. Operational parameters under control by the computer 186 include, by way of example, atmospheric pressure within the guideway sections **14*a*, communications with vehicles in the vicinity of the sections, activation and deactivation of the guideway drive stators and the frequency of wave generation therethrough, the supply of power within the guideway, and the control of guideway slide valves for isolating sections of the guideway and safety apparatus. A plurality of regional control computers are provided along the length of the guideway in order to provide for control of the various guideway operation parameters for the section under control of each regional computer. Preferably, redundant control is provided for all computers for the possible event of malfunction. Each of the regional control computers 186 is afforded communication with a central control computer system 188 which is operable to generally oversee and coordinate the various activities of all of the regional computers 184** serving the guideway. Such a hierarchical control arrangement is particularly desirable for minimizing the need for sending large amounts of data over long distances.

As the vehicles 12 transit the guideways 14, the guideway sections are normally maintained at a substantially fixed, low pressure. This environmental control is accomplished by monitoring the output of pressure sensors 190 that are positioned at intervals along the interior of the pipeline. Output signals from the pressure sensors 190 are directed to appropriate vacuum control units (VCUs) 192, which can themselves be in the form of a data processing system. The VCUs, in turn, are operable to control the function of one or more vacuum pumps 194 associated with the guideway to evacuate and maintain the interior of the guideway at predetermined pressure levels. Such control input can, for example, be of the type which continuously maintains the entirety of the guideway at a predetermined atmospheric level, or which closes guideway isolation valves 196 to allow one or more sections of the guideway to attain ambient atmospheric pressure, as would be preferred in order to provide for guideway maintenance or for emergency evacuation of one or more vehicles. Guideway access hatches 197 are provided at predetermined guideway intervals to permit service and/or rescue personnel access to the interior of the guideway following pressurization in the manner described above. Emergency exit doors **198*a* and 198*b*** are respectively provided at the forward and aft ends of the vehicle to permit passenger egress from the vehicle following any emergency stop. The exit doors are preferably electrically controlled so as to permit usage only in instances where pressure sensed in the guideway in the vicinity of the vehicle has attained habitable pressure levels. Design practice consistent with commercial aircraft results in doors which cannot be opened if the exterior pressure is significantly less than the interior.

Vehicle position along the guideway 14 is communicated from the vehicle to the regional control computer by way of an appropriate communication medium which uses, for example, radio frequency or optical energy that is received by transceivers 198 associated with the guideway for transmittance to the regional control computer 186.

Power to the guideway drive stators for each guideway section **14*a* is controlled by one or more power supplies 200, which are operable in accordance with program control input from the regional computer 186 to provide current to the drive stators of a magnitude and frequency that is in accordance with the desired velocity and acceleration for each vehicle in transit through the guideway section 14*a*. Redundant emergency power supplies 202 are preferably provided to each guideway. In the preferred embodiment, power to the drive stators for a given section of guideway is suspended, or held at a predetermined minimum maintenance level, until the vehicle is about to transit the guideway section, thereby enabling the conservation of power, cost reduction, and minimizing environmental impact. The power supply 200** is further operable to supply power to vehicle lift and steering apparatus such as electromagnets (in instances where electromagnets rather than permanent magnets are provided) and to power guideway emergency lighting and communication devices such as telephone and radio equipment.

TRANSITING OF CURVALINEAR GUIDEWAY SECTIONS

The placement of the steering coils as far apart as possible from the vehicle's center of mass, and on opposite sides (i.e. above and below) that center of mass along the vehicle vertical axis, and the orthogonal relationship between the respective vehicle lifting and steering apparatus, (i.e. the action of the steering magnet forces along the x, transverse axis rather than along the y, vertical axis) permits the transport system of the present invention to transit curved portions of the guideway at comparatively high speeds. This result is made possible because the properly applied forces of the lift and steering magnets can control and support the vehicle stably and safely even at a high bank angle. Making a sharp turn at a high speed without the passengers experiencing sideways forces requires mounting the guideway components (lift, steering and drive) at comparatively large bank angles with respect to the vertical (y) axis. The traversability of comparatively high bank angles is advantageous, for it permits the vehicle to traverse at high speed relatively short radius curves in the guideway. Furthermore, the provision of sharply curved guideway sections is particularly useful when the guideway is constrained, for example, to follow pre-existing rights of way for railroads, freeways or gas and liquid pipeline routes.

The optimum velocity of a vehicle transiting a curve, i.e., the velocity producing no side forces perceived by passengers, is a function of the bank angle that is built into the guideway. The more steeply angled the curved guideway section, the greater the speed that can be attained by a vehicle transiting the curve, according to the acceleration triangle of which the vertical side is g, the acceleration of gravity, the hypotenuse is the acceleration experienced by passengers (sensed as weight) and the horizontal side is $v^2R$, where v is the velocity and R is the (horizontal) turn radius.

Figure 11A:
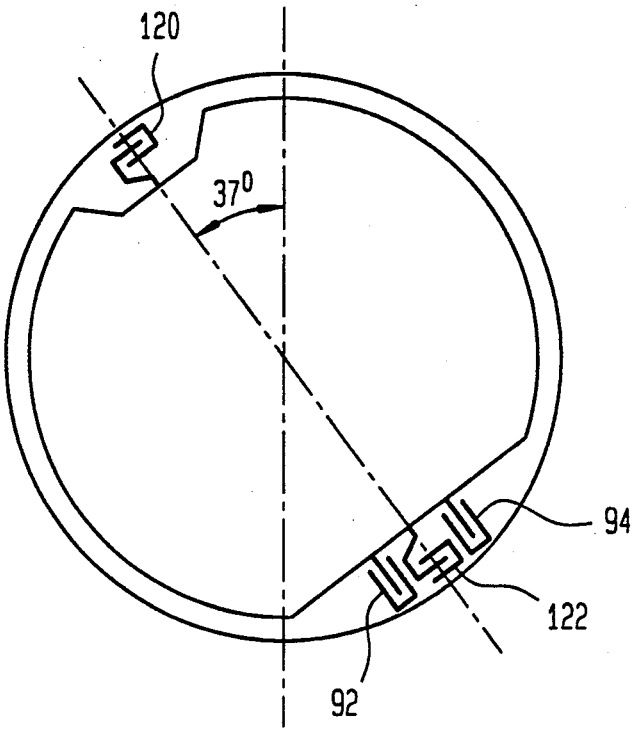
FIGS. 11A and 11B are sectional side views of a vehicle traversing a banked section of guideway.

FIG. 11A shows the lateral acceleration and the weight of the passenger (equivalent to upward acceleration g) adding to a resultant acceleration 1.25 g which is sensed as slightly increased weight, and which permits the turn to occur. This principle is well known and used in road, race track and railroad construction to permit traversing curves without imposing sideways or skidding forces. In a properly banked curve traversed at the speed given by the equation above, the respective forces acting on the vehicle balance to permit passage of the vehicle without steering control input from the vehicle operator. A road, railway or magnetically levitated transport system could, in principle, be built for any bank angle. However, it is unsafe to build in a bank angle which could not be traversed at very slow speed, because emergency stops or slowdowns must be allowed for in any transport system.

Existing wheel-on-rail transport systems, and magnetically levitated transport systems of the type under development in Japan and Germany, as described above, generally apply lateral guidance (x axis) and support (y axis) forces at locations along the lower surface of the vehicle and at its lower edges. Above a certain bank angle, the vehicles in these systems therefore would tip (i.e., pivot about the roll axis) when traveling at slow speeds along steeply banked curves. But such steep banks are desirable for the foregoing reasons to achieve high vehicle velocity compatibly with low turn radii, dictated by available rights of way. Because of their fundamental geometrical designs, the systems prior to this subject invention have to be designed with comparatively large curve radii and small bank angles, which can only be traversed at relatively low velocities, thereby diminishing attainable transportation system performance. In contrast, the vehicle of the present invention is provided with an arrangement of steering coils that are positioned on the vehicle along lower and upper extremes of the vehicle vertical dimension that are operable to develop roll torques about the vertical axis which maintain proper vehicle attitude along the guideway whatever the banking angle. The roll torques are generated by passing appropriate electric currents to the steering coils, thereby resulting in the production of corrective magnetic forces for vehicle positioning which can support a large fraction of the vehicle weight as the steering coils interact with the magnetic fields of the guideway steering magnets. The transport system of the present invention is therefore operable at high bank angles therefore at high speed simultaneous with low turn radius, and is operable further in situations where the vehicle is called upon to traverse a highly-banked curve in the guideway at a speed far below that for which the curve is designed. As noted, that can occur in instances of cautionary slowdown. In such instances, the orthogonal separation of the steering and lift forces acting on the vehicle, their independent controllability by active feedback loops, and the placement of the steering coils so that their forces are applied both far below and far above the vehicle's center of mass, permit applying magnetic forces and torques of sufficient strength and orientation, with the correct lever arms, to position the vehicle along the guideway in an optimal orientation at all speeds from zero to the banking speed.

Figure 11B:
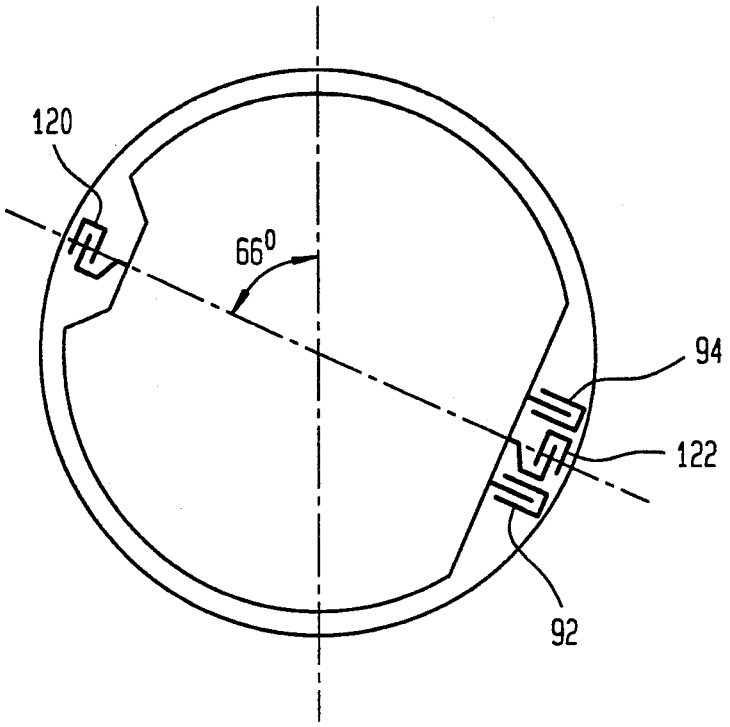

In practice, guideway geometry and rates of vehicle operation are selected by system designers in accordance with such factors as desired system passenger throughput, the magnitude of loads such as acceleration forces to be imposed upon the passengers, and the cost of right-of-way acquisition and system construction. With reference to FIGS. 11*a* and 11*b*, a numerical example is provided to illustrate the guideway geometry which results from the selection of some of the foregoing design parameters for a system constructed in accordance with the present invention. In the example, a passenger comfort criterion has been established such that passengers are not (normally) to be subjected to perceived accelerations greater than approximately 0.2 g in the +z and −z directions, and not more than 1.25 g in the perceived upward (+y) direction (i.e., passengers are not to be subjected to a perceived downward force in excess of 25% their normal weight). In this regard, the design constraint of vertical acceleration of 1.25 g is considerably less imposing than what is normal for airline passengers, especially during turbulence. As the foregoing acceleration limits are set in accordance with passenger comfort constraints rather than as a consequence of technical limitations, they depend not on absolute physical limits but on overall system performance objectives that are established for the transportation system.

The establishment of the particular passenger comfort constraints listed above allows a maximum guideway bank angle of approximately 37°, as depicted in the geometric representation in FIG. 11A, in which the accelerations applicable for the curved region are represented by a right triangle. The sides of the triangle exhibit the relationship 3:4:5, and each side represents an acceleration vector that is applied to a passenger. Accordingly, the approximate bank angle of 37° is derived from arcsin (3/5) 36.9°. The vertically-extending side of relative length 4 represents the accleration corresponding to normal gravity (i.e., $g=9.8\ m/s^2$). The horizontal side of relative length 3 represents the acceleration that produces motion in a circle (i.e., $a_t$ where transverse acceleration $a_t=v^2/R$ with v=velocity and R=curve radius). From the triangle, $a_t=\frac{3}{4}$ g or 7.35 $m/s^2$, which is higher than the transverse accelerations possible in many prior transport systems. The total acceleration experienced by passengers corresponds to the side of relative length 5, which is 5/4 or 1.25 the acceleration of gravity. When the curve is traversed at normal speed, passengers experience only an apparent weight in the perceived "down" direction. Its magnitude is 1.25 where m is passenger mass. For a vehicle which is to traverse the curve at 300 m.p.h. (134 m.p.s.), R=1.48 miles, approximately 14% of that which is the safe limit for a conventional wheel-on-rail system at the same speed v.

As shown in FIG. 11B, higher bank angles, and therefore greater vehicle speeds, can be achieved by the transport system of the present invention without unduly compromising the passenger comfort constraints set forth above. These higher bank angles are achievable by configuring curved portions of the guideway with a transverse curve in the horizontal direction that is concurrent with a vertical curve. As the downward acceleration $a_v$ for the curve is provided by the relationship $a_v=v^2/R_v$, where v represents vehicle velocity and $R_v$ represents vertical curve radius, a value for $R_v$ is, for example, selected such that the net downward force on the passengers is half that of gravity (i.e., $F=ma=mg/2$). If the total force experienced by passengers is again to be 1.25 g, as in the previous 37° bank angle example (FIG. 11A), then the bank angle $\theta$ is determined to be $\theta=\arccos[mg/2]/[mg(1.25)]=66.4°$. The transverse force is therefore determined to be $F=\tan 66.4\ (mg/2)$, which is approximately 1.15 mg. The transverse force is therefore 115% of normal gravity as compared to approximately 75% of normal gravity which was calculated in the previous numerical example. Thus, a guideway section having an even smaller horizontal curve radius than that described above can be implemented while maintaining passenger comfort at the correct banking speed. For vehicle travel at a rate of 300 m.p.h., a curve radius of only about 0.97 miles need be provided, thereby allowing conformity to even tighter right-of-way constraints. Because of the geometrical and control properties of the lift and steering magnets of the present invention, such a compound curve could be traversed safely even at very low speed. Such traverse would only occur under emergency slowdown conditions, and could be made adequately comfortable by the provision of seats rotatable about the roll axis, or by suitable lateral padding.

PASSENGER CHANGEOVER

Figure 12A:
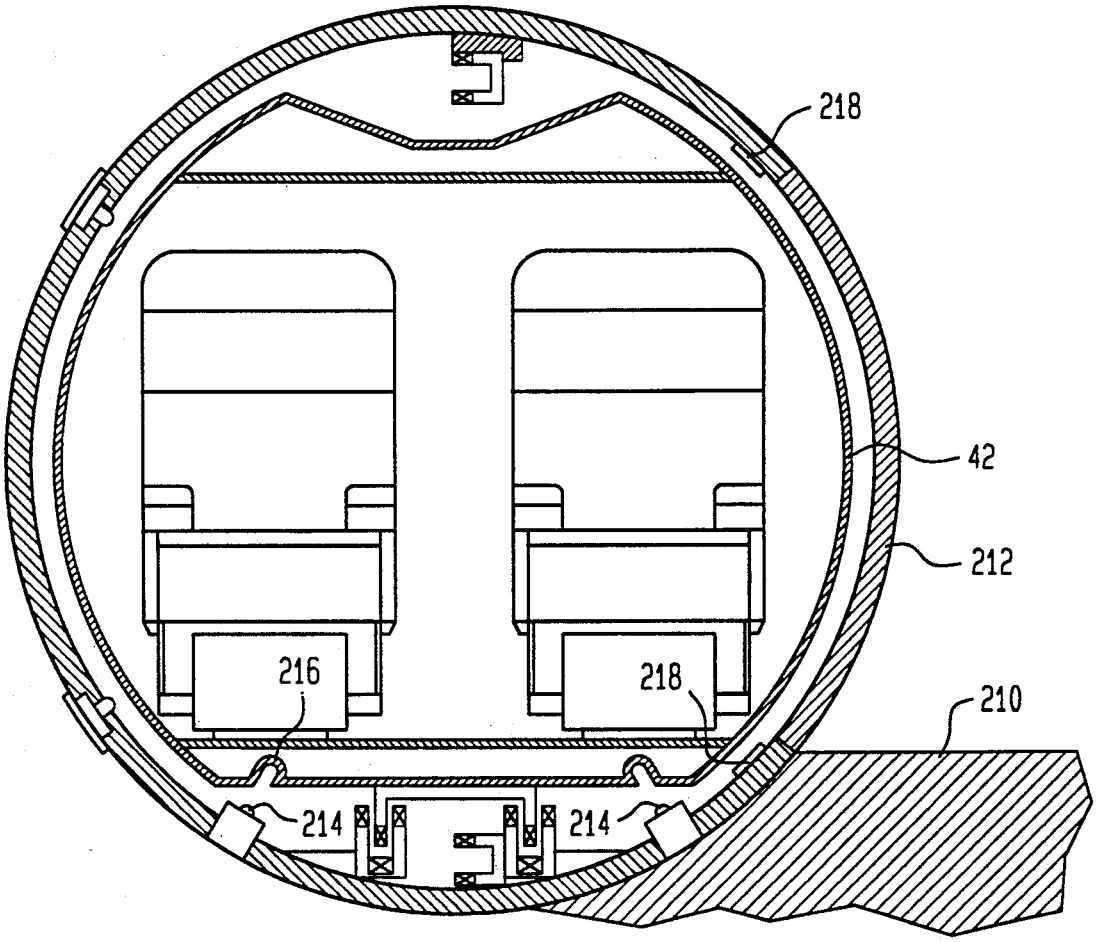
FIGS. 12A and 12B are sectional side views of vehicle passenger boarding and exit apparatus.
Figure 12B:
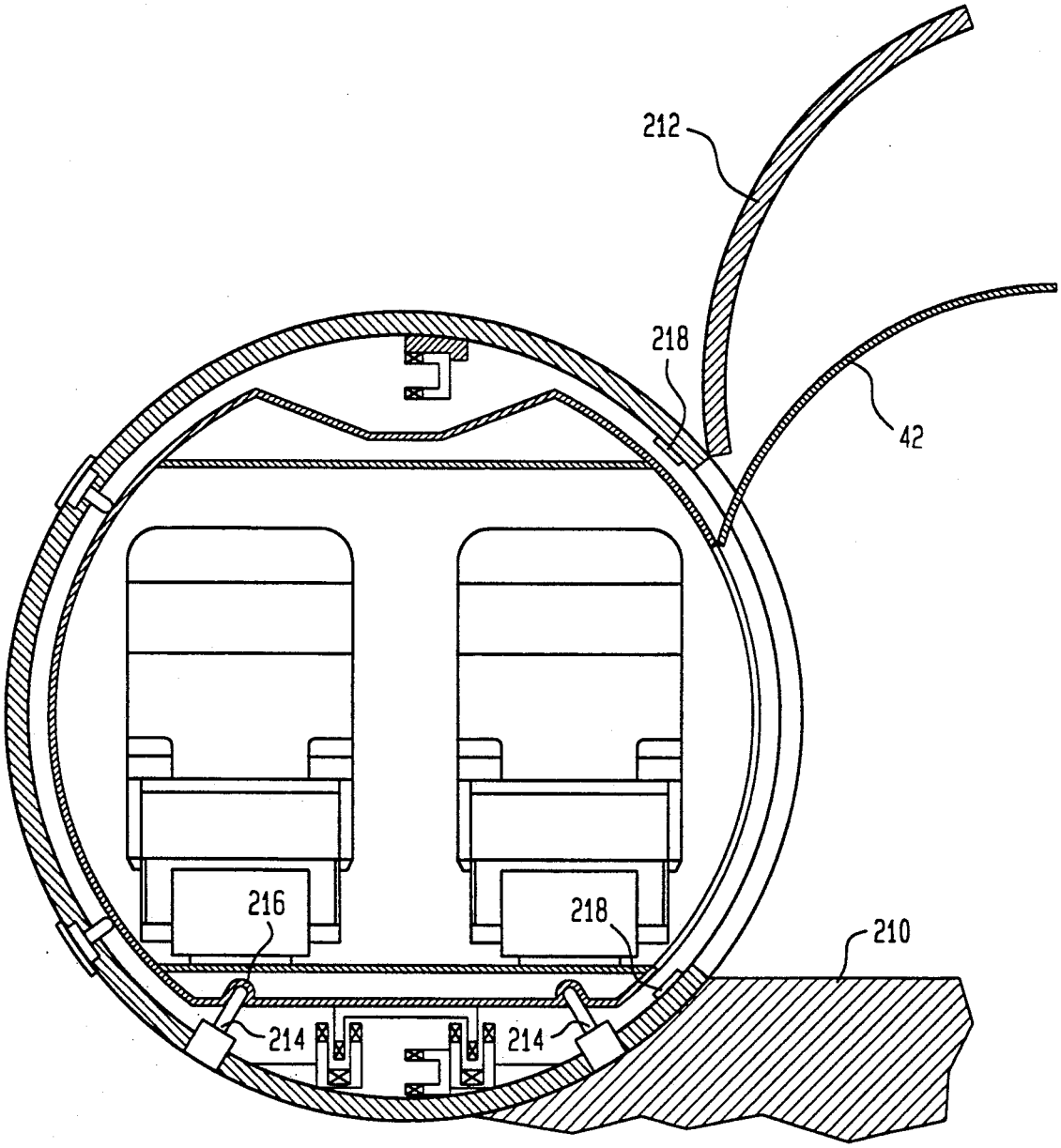

Passenger entry and exit from vehicles is preferably accomplished in a manner which minimizes energy requirements for pumping air in cases in which the present invention includes a guideway within a partially evacuated pipeline. With reference to FIGS. 12A and 12B, there are depicted in schematic form details of an airlock system for use in passenger changeover when a train has been decelerated to a stop at a station 20 (FIG. 1). Vehicle deceleration is accomplished by diminishing the frequency, magnitude and direction of pulse propagation along the guideway drive stators 82 and 84 in the manner described above with reference to z-axis control. As shown in FIGS. 12A and 12B, each vehicle is preferably brought to rest adjacent to the passenger platform 210 in the station such that the doors 42 of each vehicle cabin 28 generally coincide with passenger doors 212 formed in the tunnel guideway. The guideway is provided with one or more extensible vehicle stabilizers 214 such as screw jacks, which are operable, as shown in FIG. 12B, to engage the vehicle within a vehicle recess 216 to provide a firm backing for the door seals and to permit, if more convenient or economical, the shutdown of magnetic forces during the course of passenger egress and ingress. A reciprocably extensible guideway seal 218 surrounds the outer periphery of the station door 212 and is operable to extend from the inside tunnel wall to engage the outer periphery of the vehicle adjacent to one or more doors 42 (prior to door opening) to provide a normal-pressure path which extends between the station and the vehicle through which passengers can pass.

As shown in FIGS. 12A and 12B, the vehicle stabilizers 214 and seal members 218 are received within recesses 220 that are formed within the wall of the guideway. The seals can, for example, be operated pneumatically to extend, and be retracted by, spring forces. The extended seal member creates a substantially airtight seal for the area between the outer surface of the cabin and the inner surface of the guideway section. A pressure sensor is provided within the space partitioned by the seal which monitors the environment within this airtight area. Output data from the sensor is transmitted to one or both of a station computer and the guideway regional control computer 186 for control of operation of the station doors 212. Following the establishment by the seal 218 of an enclosed passage between a given cabin door 42 and a corresponding tunnel door 212, air is admitted through an air inlet (not shown) within the confines of the seal into the area enclosed by the seal until output from a pressure sensor (not shown) that is associated with each seal indicates that prescribed atmospheric pressure has been achieved. Once prescribed atmospheric conditions have been attained, the regional or station computer is operable to direct opening of the guideway door 212 and to transmit a control signal to the vehicle computer 135 to effect the opening of the one or more cabin doors 42 enclosed by the seal. Once passenger exit and entry has been completed, the vehicle computer 135 directs closing of the cabin doors 42, after which is initiated the seal depressurization and retraction process and guideway door closure.

The pressure seal 218 can be implemented along a single side of the guideway tunnel or on both sides of the tunnel to accommodate the exiting and boarding of passengers from both sides of the cabin simultaneously or alternatively for accommodating station passenger handling arrangements in which passenger ingress/egress is accomplished from a single side of the vehicle, as is the case with many transport systems. One or more seal members 218 can be provided in the pipeline segment at the boarding station for each vehicle comprising the train. As was noted above, the train can optimally be subdivided while still in motion into a plurality of multi-car segments. The primary reason for such subdivision is to permit managing the multi-car segments in such a way that every passenger travels nonstop to his or her destination. A second reason is for convenience in passenger boarding and exit. For example, a train arriving at a large station can be subdivided into a plurality of segments, the lengths of which correspond generally to passenger platform length, and those segments can be switched onto different but nearby, generally parallel stubs to implement rapid and convenient passenger changeover in the vehicles constituting the train.

EMERGENCY OPERATION

The transportation system is constructed to ensure passengers' safety in the event of an emergency. Emergency situations in the guideway can generally be categorized in one of two varieties. In the first type of emergency, the guideway is usable, but the trains must proceed at least temporarily at a slow speed. The second type of emergency situation arises when a train is forced by adverse conditions either in the guideway or on board one or more of the vehicles thereof to stop at an arbitrary location in the guideway. In this latter situation, passengers must be permitted to exit the vehicle safely within the tunnel itself, and provisions must be included to permit vehicle access by emergency rescue personnel from outside of the tunnel. Access to prescribed sections of the guideway is provided by the pressure hatches 197 (FIG. 10) that are disposed at regularly spaced intervals along the guideway. Passenger access to the interior of the guideway is provided by the vehicle hatches 198*a* and 198*b*. The vehicle hatches are made to be operable only after air pressure within the guideway section in which the vehicle has stopped has been brought to normal atmospheric pressure, as is possible within a few seconds following closure of the guideway slide valves 196 and the admission of air into the closed guideway section by valves. Such vehicle hatch operation can be accomplished by the use of pressure sensors at the hatch exterior and the provision of a hatch interlock that is operable to inhibit hatch opening until pressure has equalized on the two sides of the hatch.

VEHICLE POSITION ALONG THE GUIDEWAY

In a preferred aspect of the invention, vehicle position along the guideway along the longitudinal (z) axis is continuously monitored by one or both of the vehicle on-board computer 131 and regional computer 186.

With reference to FIG. 10, the longitudinal location of the vehicle is preferably optically measured using two redundant methods. One is preferably a bar code 220 that is comprised of a plurality of longitudinally-extending lines 222 that are provided along the inner wall of the guideway, and an array of optical sensors 224 that are mounted to the vehicle, preferably along one of the vehicle wings 30, 32. An exemplary bar code is depicted in FIG. 13 for illustrative purposes. The bar code 220 is comprised of an array of, for example, 24 horizontal lines 222 (three of which are shown) which extend along the length of the tunnel. However, other bar code arrangements can be provided. Each line 222 is preferably read by an optical sensor 224 that corresponds in position to a single one of the plurality of horizontal lines. Each of the lines 222 forming the bar code comprises binary data to subdivide a length, for example, approximately 167 km, of the guideway into 1 cm intervals. The binary data consists of alternating light and dark segments 228 and 230, respectively, which respectively correspond to binary 0's and 1's. The aggregation of lines 222 along the guideway in the z direction indicate uniquely each 1 cm interval along a length of 167 km. Any of a variety of indicia can be used to distinguish between 167 km segments. The start point is, for example, all zeros. Following a bar code pattern of all ones, the bar code pattern repeats itself, thereby representing another approximately 167 km section of guideway. The width of and separation distance between bar lines is selected to allow for substantially continuous detection by the optical sensors and to accommodate the maximum possible excursion of the vehicle in the x and y directions. The vehicle computer 135 utilizes the optical sensor data relating to z-axis position to calculate where the vehicle is along the guideway at each moment of time. Because of the possibility of damage to a portion of a bar-code line, all computer programs associated with z-motion preferably are provided with z-axis cross-checks based on known laws of physics, $$\text{velocity} = (\text{acceleration}) \times (\text{time})$$

$$\text{distance} = (\text{velocity}) \times (\text{time})$$

both in their integral form with prescribed starting values (see below). In this way a momentary wrong signal as to z position will be noted by the computer, but no emergency deceleration will be applied and no false signal as to train position will be sent to the central or regional guideway computers.

As previously described, proper vehicle position in relation to other vehicles in the guideway is determined by the regional guideway computer 186 handling the guideway segment in which the vehicle is traveling. Vehicle position data is relayed to the central computer 188 for dissemination through the guideway communications network to any one or more of the regional computers 186.

The redundant second method of establishing z-axis position for each vehicle is preferably counting, through an optical reader by the onboard computer 135, of a simple pattern of binary zeros and ones (light and dark marks) at, for example, one centimeter intervals along the guideway. A given total count corresponds to a unique position along the z-axis. Proper vehicle position data, i.e., desired z-axis versus time information, is generally transmitted by the regional computer 186 to each vehicle in the guideway over the guideway communication network in the form of, for example, optical, microwave or infrared data signals. In addition, this information can be transmitted to the central control computer 188 to permit tracking of vehicle and train progress throughout the entire transportation system. Suitable identification data, such as prefix codes, format codes, transmission frequency and the like, can be used by each regional computer to uniquely identify for the central control computer 188 the specific guideway section a vehicle or vehicle train is 5 transiting at a given time. Each vehicle is preferably assigned a unique address to permit communication of a variety of different vehicle operating parameters as well as position along the guideway. An algorithm stored in the memory of the vehicle computer 135 determines instantaneous vehicle velocity V pre-programmed for that z-position using the relationship $V(t)=V_o+\int a(t)dt$, where $V_o$ is the initial vehicle velocity and a=instantaneous acceleration. Instantaneous vehicle position Z(t) along the z-axis is subsequently determined by the relationship $Z(t)=Z_o+\int v(t)dt$, where $Z_o$ is an initial vehicle position. If the vehicle computer determines by comparison of Z(t) with position data in a look-up table stored in memory, or in the output number from an algorithm which is time-dependent, that the vehicle is behind or ahead of its proper z-axis position in the guideway, the vehicle computer is operable to increase or reduce, respectively, the driven coil current until any discrepancy between the measured actual Z(t) value and the calculated, desired position reach zero. As the onboard computer 1235 is preferably operable to modulate the near-constant electric current passing through any one or more of the driven coils 86 and 88 selectively during acceleration and deceleration, the vehicle is therefore capable of riding the maximum of the drive magnet's magnetic field cycle, rather than having to "lag" as in the case of some electric motors. This allows the drive stators 82 and 84 and the driven coils 86 and 88 to run at comparatively lower power than would otherwise be possible. However, any one or more of the vehicle (driven) magnets can be energized by permanent magnets rather than by ohmic conductors, as long as a mechanism for control of thrust is provided either in the drive or driven coils.

Prior to departing from a boarding station, each vehicle computer 135 is preferably operable to apply control forces and torques to the vehicle steering and lift coils (i.e., exercise the vehicle in the five non−z axes degrees of freedom) and measure resulting vehicle motion using sensor output signals from sensors S1 through S6 (FIG. 8). The vehicle computer is operable to analyze the resulting vehicle motion to determine the three dimensional location of the vehicle center of mass CG, which is generally unsymmetrical and changes with passenger and baggage changeover at a station stop. By the same means, the vehicle computer is operable to determine the correct set of constants for the center of mass (CG) coordinates and moments of inertia for that particular vehicle load for use in calculating the proper forces and torques to apply when the vehicle is in motion. Exercise of the z-axis degree of freedom permits measuring the total loaded mass.

Due to the manner in which the electrostatic position sensors S1 through S6 work in cooperation with static plates which are mounted to the guideway magnets, as described above in connection with FIG. 8, the independence of one vehicle from others allows a simple method for detecting guideway steering and/or lift magnet misalignment. When a vehicle passes a misaligned magnet, the vehicle's momentum and the near uniformity of the lift and steering magnet fields prevent it from deviating appreciably from its proper trajectory. The vehicle therefore serves as a position reference with respect to the magnet alignment. If the vehicle's position sensors detect a position in the total (example, ±20 mm) clearance space that is anomalous with respect to an optimum trajectory (for which see below) the vehicle signals that anomaly to the nearest guideway computer for recall to subsequent vehicles. Subsequent vehicles transiting the affected guideway section are preferably notified by the control computer 186 to expect a deviation of position measurements at the misaligned guideway section and (prior to realignment) to regard such deviation as being "normal". That method therefore inhibits the generation of forces or torques that would otherwise be generated (jolts) and affords the passengers a smooth ride.

This feature of the method of the present invention is that the vehicle control and steering program works from a look-up table of magnet positions, and centers the vehicle on a smooth, safe trajectory. It does not attempt to follow the possibly irregular sequence of magnet positions. In this way the subject invention is able to provide a smooth ride (i.e., no jolting irregularities) while at the same time tracking the computed trajectory with a feedback control system which has high fidelity, that is, tracks closely because of high loop gain in feedback.

In accordance with a further aspect of the present invention, the vehicles 12 are each independently operable to perform trajectory calculations and corrections during the course of transit through the guideway. Preselected vehicles of the vehicle train, such as one out of every five to ten vehicles, record the displacements of each guideway magnet through which they pass, and a record is compiled in the vehicle's onboard computer 135 as to the vehicle's electrostatic (i.e., capacitance) or alternative position sensor readings, which are made relative to points attached to the magnets. That record is then communicated at frequent intervals to the guideway regional computer, and from it to the central computer. In that way the central computer has a frequently updated record of the alignment of every magnet. It communicates that record to later vehicles and later trains, together with a prescription for what alignment values should be sensed by a vehicle on an optimum trajectory.

In detail, vehicle trajectory adjustment in this embodiment is accomplished by first collecting quantitative data on magnet positions from the vehicle position and field sensors, which as mentioned above, are preferably attached to the lift and steering coils. The positions are then communicated to the regional control computer 186 where they constitute look-up tables. In operation, aspects of the various magnet and magnet assemblies of the vehicle are represented by numerical values. For example, the top steering magnet is preferably represented by six different numerical values: two of which represent x and y coordinates for the center of the gap at the entrance end of the magnet, two more values which are representative of the exit end, (optionally) one value which is indicative of an angle of rotation for the magnet's adjustment with respect to an axis parallel to the roll axis (z axis), and one value which represents the product of the magnet's effective length and its average magnetic field. The last is important because a magnet with excess or deficient field, even if properly aligned, applies a non-standard force to the vehicle current. Correction of that difference is carried out by shimming the magnet during a maintenance period, or in the case of magnets driven by electric currents, by altering those currents by computer control.

Preferably, the cluster of steering and lift magnets along the lower surface of the vehicle is built as an integral assembly and therefore can be characterized by another set in this case of eight numerical values (two sets of x and y coordinates at the entrance and exit ends of the guideway magnets, one indicative of rotation, and field values for the three magnets) in the manner described above. A fifteenth numerical value can optionally be recorded if, for any reason (such as a broken part) one of the lift or steering magnets cannot be characterized in the foregoing manner. Lastly, a sixteenth numerical value, identifying the individual guideway magnet section, is preferably obtained, as can be accomplished by recording the bits which uniquely identify the beginning or end of the magnet along the z-axis bar code.

The vehicle transiting the guideway also records and transmits to the regional control computer 186 two additional numerical values relating to the guideway: the x and y accelerations sensed by the vehicle during traverse of the given magnet segment. The vehicle transmits these numbers for each magnet or magnet assembly through the guideway communication system to the regional control computer. As noted above, because the guideway magnets have near uniform fields, there is, to the first order, no appreciable affect on the magnet's lift or guidance forces on the vehicle due to x or y errors in the magnet's position. That uniformity is required in order that the vehicle center on a smooth, minimum curvature trajectory without receiving jolting impulses from misaligned magnets.

Either one or both of the guideway computer 186 or the central computer 188 is operable to calculate from position information received from the vehicles transiting the guideway the x and y (and optionally angular, if significant) errors of each of the guideway magnets. From that processed data, the computer is operable in a conventional manner to determine an optimal trajectory for vehicles which subsequently transit the guideway. The optimal trajectory is determined from such criteria as maximum clearance from misaligned magnets and minimum departure from the optimal path (i.e., one providing maximum horizontal and vertical curve radii). The path determination can be an iterative process in which an optimal path is (electronically) traversed by the control computer 186 or 188, after which the traversed path is evaluated to determine whether at any point the path falls outside pre-set limits (for example, passes through a point where clearance is reduced below a minimum threshold value because of the x, y, or angular error of a particular magnet). If the first iteration does not fall within pre-established limits, the second iteration is to modify the ideal path by a minimal amount, as can be accomplished, for example, by a half-sinusoidal departure of small amplitude and large wavelength (resulting in minimal lateral or vertical variations in force as sensed by the passengers).

Either one or both of the control computers 186 or 188 is operable to construct a table of magnet position differences from zero as measured by the position sensors of a vehicle that is traversing the guideway along the calculated best available trajectory. The position difference data is transmitted along a guideway communications data bus to the following train, and optimally to the latter portion of the original train which has yet to complete its passage along the guideway section. Each vehicle of the following train can store in its computer memory a table of position differences from zero which its capacitance or other position sensors should measure if the vehicle is on the best available trajectory. The vehicle's onboard guidance system, which controls it in its five non−z axis degrees of freedom, operates to guide the vehicle through the guideway, working from a table of differences which contain data that permit the vehicle to correct for magnet position errors. The foregoing guidance system is therefore operable with its feedback loops to produce a trajectory which is as close to the predetermined optimal trajectory as possible, rather than responding to signals which change with every magnet section because of magnet errors. Traversing a series of imperfectly aligned guideway magnets while maintaining maximum practical clearance and without imposing transverse impulses or "jolts" on the vehicle's passengers is possible as a result of the combination of nearly uniform magnetic fields in the present transportation system, the provision of vehicle lift and steering by electric currents passing through those nearly uniform magnetic fields, the measurement of magnet positions and fields as detailed above, the calculational process of optimum path determination as also detailed above, and the communication to each vehicle of the lookup table of magnet positions corresponding to the calculated optimal path.

GUIDEWAY SWITCHES

As was discussed above in connection with the transport system 10 depicted in FIG. 1, the guideway 14 can include a plurality of guideway switches 22 which provide for vehicle transit from one guideway section to one of a plurality of available alternative guideway routes. It is a feature of the present invention that switches can be traversed at high speed both on the left and the right alternative routes of the switches. In conventional railroad practice switches generally have only one alternative, a straight track, which can be traversed at high speed.

Figure 14A:
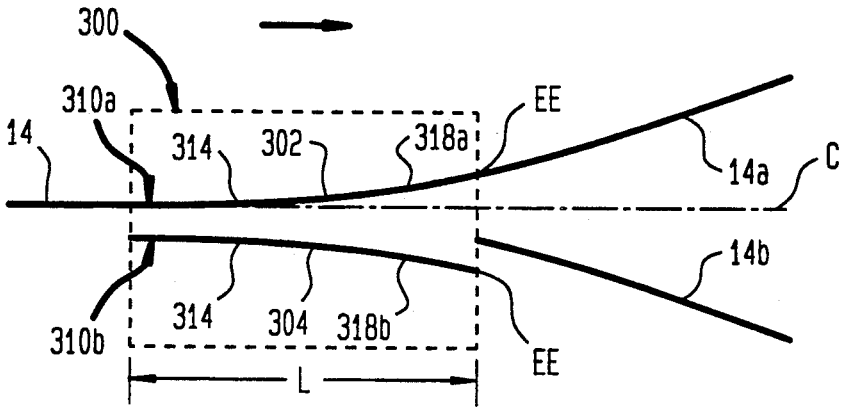
FIGS. 14A and 14B are schematic overhead views of a guideway switch.
Figure 14B:
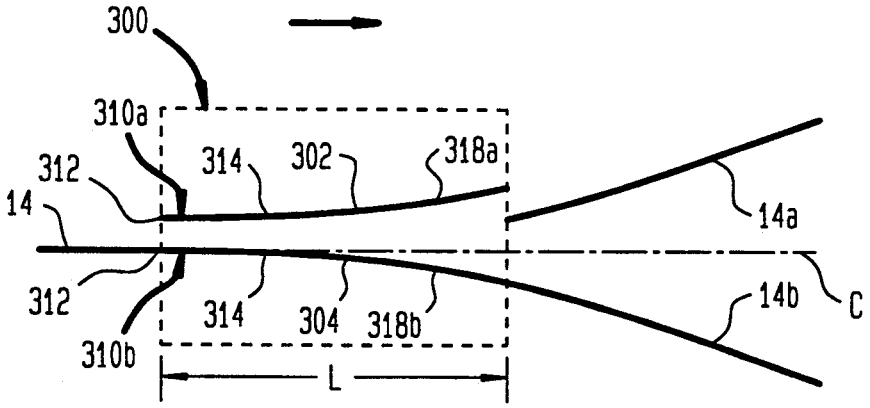

Vehicle transfer to a desired alternative guideway route is accomplished by a switch assembly 300 of the configuration depicted in FIGS. 14A and 14B. While the switches are operable for vehicle travel in either direction, the following description is provided for vehicle travel from left to right in the drawings. With reference to these drawings, in which complete guideways (including first and second drive stators 82 and 84 and lift magnets 92 and 94, and upper and lower steering coils 124 and 126 and their respective operation and control components) are represented by single lines, the switch network 300 is configurable as a longitudinally or left/right symmetrical array of leftwardly and rightwardly extending guideway segments 302 and 304, respectively, that are laterally displaceable in the region denoted by the dashed line in the drawings. For a given speed, configuration of the switch in this symmetrical manner affords a nearly 30% reduction in overall switch length L as compared to a switch in which one path is straight and the alternative path is curved. Conventional switch geometry with one straight and one curved alternative can be used with the transport system of the present invention in cases where extremely high vehicle velocities are used on one path.

In general, a switch for which a high speed can be used on both alternative routes must be designed with correct banking for the turn radii and speed. The banking of curves results in a separation distance between top steering magnets which is greater in the curved portion of a switch than is the separation distance between the lower magnets (i.e., lift and guidance magnets). The switch network 300 terminates at a point along the z-axis where s(z), the value of the separation distance between the lower magnet assemblies when traversing the left and right guideway switch alternatives, is large enough to separate fully the two alternative guideways, without mechanical motion. If the curve radius allowed for the design speed V is R, the length of a conventional straight and curved alternatives switch is given by $$L = \sqrt{2(s)R}\ .$$

Here, s is a guideway separation distance, and $R = V^2/a_T$, where $a_T$ is the maximum transverse acceleration that has been set for the system, an example being 7.5 m/sec$^2$. Because, in the symmetrical switch of the present invention, half of the required separation in the symmetrical switch is to the left and half to the right, respectively, of the center line C of the vehicle path prior to reaching the switch, the distance s(z) for adequate separation from the center line is half as much as in the straight and curved alternative case. The length of the symmetrical switch is then $$L = \sqrt{2(s/2)R}\ ,$$

which is $1/(2)^{\frac{1}{2}}$ or 0.71 of the length of the conventional switch. Both calculations omit the length required for roll to the correct banking angle for R and V. In conventional railroads, switches are generally not banked, and trains must slow to a relatively low speed before taking a curved alternative path. In contrast, because of switch symmetry and method of operation, symmetry and guideway banking in the manner described above, the switch of the present invention can be traversed at a relatively high rate of speed.

The switch segments 302 and 304 are laterally displaceable as a collective unit so as to position one of the segments 302 or 304 and the various drive, lift and steering components thereof in alignment with the same components comprising the guideway 14 and leftwardly and rightwardly extending segments 14*a* and 14*b* thereof. Appropriate motor drive apparatus (not shown) is provided that is operable in advance of vehicle arrival at the switch in accordance with control input received from one or both of the regional control or central computers. The drive stators 82 and 84, lift magnets 92 and 94, and steering magnets 120 and 122 are preferably progressively banked along a first transition section 310*a* and 310*b* (i.e., a section which carries out a roll) formed along each of the guideway segments 302 and 304, from an angle of about 0° at the entrance (left or first end) 312 of the switch toward a point 314 in the switch where the bank angle is on the order of about 37° to ensure that the passengers do not perceive any lateral forces during the course of vehicle passage through the switch. The transition sections 310*a* and 310*b* maintain roll acceleration imparted to the passengers within levels associated with conventional terrestrial and airborne transportation systems. The guideway bank angle in the switch (nominally an angle of up to about 37°) is maintained from the end of the transition section through the curve to the start of the final transition section. In the departure transition sections 318*a* and 318*b*, the bank angle progressively diminishes from about 37° until it reaches the normal operational angle of about 0°.

TRAIN ASSEMBLY/DISASSEMBLY

As mentioned above, the vehicles 14 of the subject invention can be assembled in the manner described below prior to station departure or while en route to a predetermined destination. Such aggregations of vehicles are useful to transport large numbers of passengers and/or quantities of freight from one or more stations to a common station. The vehicles can likewise be removed from the trains in an analogous fashion to provide for the passage of comparatively small numbers of passengers and/or amounts of freight to a multitude of destinations such as suburban stations without necessitating stoppage of the entire train and the otherwise unnecessary delays and energy waste associated therewith at each and every station. Such flexibility in vehicle handling arises from the construction and control of the vehicles as independently controllable rigid bodies having a minimum number of degrees of freedom, as the computer control system associated with each vehicle is operable to control its associated vehicle substantially independently of the other vehicles constituting the train.

Vehicle trains can be formed in one of two arrangements: close proximity travel and physical coupling. Close proximity travel, in which vehicle separation distances of typically on the order of 5 cm to about 100 cm are maintained throughout the course of train travel, are possible as a result of the nearly continuous calculation and exchange of vehicle position information along the guideway that is possible with the vehicles, computers, and guideway of the subject invention. Such vehicle position information can be exchanged directly between any one or more of the vehicles comprising the trains, but is preferably exchanged between each vehicle and the nearest regional computer of the guideway.

Withdrawal of one or more vehicles from the train can occur prior to train approach to switches 22 (FIG. 1) in accordance with, for example, program control applied to the onboard computer by the regional computer having at that time jurisdiction over the vehicle or vehicles to be removed from the train. The program control input which effects vehicle separation can be based on, by way of example, z-axis position data obtained from each vehicle's scanning of the guideway bar code 222 that is provided along the interior wall of the guideway tunnel in the manner described above.

In the example of FIG. 1, relatively low-speed switches are provided to allow vehicles which have been separated from the train earlier on the relatively straight high-speed track to be switched on to the side track after they have slowed to a suitable speed. On the side track they stop at station STN 1. While low-speed switches and side tracks are common existing practice, the ability to form and separate trains at high speed is a feature of the present invention. It makes possible the delivery of every passenger to his or her destination as a nonstop trip. The system can therefore serve many stations, but with the expedited service to passengers characteristic of nonstop express trains.

The foregoing detailed description is illustrative of various preferred embodiments of the present invention. It will be appreciated that numerous variations and changes can be made thereto without departing from the scope of the invention as defined in the accompanying claims.

What is claimed is:

1. A transportation system comprising:

a vehicle guideway including means for generating first time-varying magnetic field waves, a plurality of lift magnets, and a plurality of steering magnets, said lift magnets and said steering magnets are formed of permanent magnets for generating a uniform magnetic field;

said lift magnets have a U-shape including a pair of parallel legs and a bottom perpendicular to said legs, said plurality of lift coils are positioned within said parallel legs whereby the interaction between said lift magnets and said lift coils is substantially independent of the location of said lift coils over said bottom, said steering magnets have a U-shape including a pair of parallel legs and a bottom perpendicular to said legs, said plurality of steering coils are positioned within said parallel legs whereby the interaction between said steering magnets and said steering coils is independent of the location of said lift coils over said bottom, said parallel legs of said lift magnets are positioned 90° with respect to said parallel legs of said steering magnets, and at least one of said steering magnets is positioned between said lift magnets, a vehicle transportable along said guideway in spaced relation therefrom, said vehicle includes a first and second wing and a cabin positioned between said first and second wing, at least one of said plurality of lift coils is mounted on said first and second wings respectively and at least one of said plurality of steering coils is mounted on said first and second wings, a plurality of conductors mounted on the vehicle wherein said conductors are interactive with said first magnetic field waves for propelling said vehicle along said guideway;

a plurality of lift coils attached to said vehicle and interactive with said lift magnets for lifting said vehicle in a vertical direction above said guideway, said coils receiving electric current;

a plurality of steering coils attached to said vehicle and interactive with said steering magnets for steering said vehicle in a horizontal direction above said guideway; and means for supplying electric current to said steering coils, at least one of said steering magnets is positioned between said lift magnets, wherein at least one of said plurality of steering coils is mounted above said vehicle and at least one of said plurality of steering coils is mounted below said vehicle so that said vehicle is transportable up to a guideway bank angle of 37° with respect to the vertical axis of said guideway.

2. The transportation system according to claim 1 wherein said guideway has a vertical and horizontal axis and wherein said lift magnets are interactive with said lift coils for rotating said vehicle around said horizontal axis of said guideway and wherein said steering magnets are interactive with said steering coils for rotating said vehicle around said vertical axis.

3. The transportation system according to claim 2 further comprising:

a first means for supplying power to said lift coils and a second means for supplying power to said steering coils.

4. The transportation system according to claim 3 further comprising:

a means for sensing the position of said lift and steering magnets from said lift and steering coils and means for controlling said first and second means for supplying power to said respective lift and steering coils in response to said sensed steering coils, thereby controlling said vehicle movement in said vertical and horizontal directions above said guideway and said rotation around said vertical and horizontal axes of said guideway.

5. The transportation system according to claim 4 wherein said means for controlling said first and second means for supplying power comprises a control computer including a look-up table of sensed position of said lift and steering magnets from nominal part at alignment of said lift and steering coils.

6. The transportation system according to claim 5 further comprising:

a switching system having an array of second guideway segments positioned laterally to one another and to said first guideway wherein during the transportation of said vehicle along said second guideway segments said vehicle is transportable at said guideway bank angle of up to 37° with respect to the vertical axis of said guideway.

7. The transportation system according to claim 6 further comprises:

means for controlling said means for generating said first magnetic field waves according to said switching system for arranging a plurality of said vehicles to form a train system.

* * * * *